US006141508A

United States Patent [19]

Sasaki et al.

[11] Patent Number: 6,141,508

[45] Date of Patent: Oct. 31, 2000

[54] DEVELOPING APPARATUS AND PROCESS CARTRIDGE

[75] Inventors: Teruhiko Sasaki; Satoshi Kurihara, both of Toride; Tsutomu Nishiuwatoko, Kashiwa; Toru Koizumi, Toride, all of Japan

[73] Assignee: Canon Kabushiki Kaisha, Tokyo, Japan

[21] Appl. No.: 09/316,024

[22] Filed: May 21, 1999

[30] Foreign Application Priority Data

May 22, 1998 [JP] Japan ..... 10-156869

[51] Int. Cl.[7] ..... G03G 15/08; G03G 21/16

[52] U.S. Cl. ..... 399/27; 399/30; 399/111

[58] Field of Search ..... 399/27, 30, 61, 399/62, 258, 111

[56] References Cited

U.S. PATENT DOCUMENTS

| | | | |
|---|---|---|---|
| 5,500,714 | 3/1996 | Yashiro et al. | 399/111 |
| 5,543,898 | 8/1996 | Shishido et al. | 399/111 |
| 5,585,902 | 12/1996 | Nishiuwatoko et al. | 355/260 |
| 5,652,647 | 7/1997 | Yashiro et al. | 399/111 |
| 5,689,772 | 11/1997 | Fujiwara et al. | 399/106 |
| 5,729,796 | 3/1998 | Miura et al. | 399/114 |
| 5,768,658 | 6/1998 | Watanabe et al. | 399/111 |
| 5,768,660 | 6/1998 | Kurihara et al. | 399/111 |
| 5,815,644 | 9/1998 | Nishiuwatoko et al. | 399/113 |
| 5,870,655 | 2/1999 | Nishiuwatoko et al. | 399/111 |
| 5,893,006 | 4/1999 | Kanno et al. | 399/13 |
| 5,899,607 | 5/1999 | Kawaguchi et al. | 399/258 X |
| 5,920,753 | 7/1999 | Sasaki et al. | 399/111 |
| 5,923,917 | 7/1999 | Sakurai et al. | 399/27 |
| 5,923,918 | 7/1999 | Nakawaga et al. | 399/27 |
| 5,937,240 | 8/1999 | Kanno et al. | 399/111 |
| 5,946,522 | 8/1999 | Inami | 399/27 |
| 6,026,253 | 2/2000 | Domon et al. | 399/30 |

FOREIGN PATENT DOCUMENTS 4-13166 1/1992 Japan .

*Primary Examiner*—Susan S. Y. Lee

*Attorney, Agent, or Firm*—Fitzpatrick, Cella, Harper & Scinto

[57] ABSTRACT

A developing apparatus for developing a latent image formed on an electrophotographic photosensitive member includes a development member for conveying developer to the electrophotographic photosensitive member to develop the latent image formed on the electrophotographic photosensitive member; a developer storing portion for storing the developer used by the development member to develop the latent image; a developer supplying opening for supplying the developer stored in the developer storing portion, to the development member; and a developer remainder amount reporting member disposed within the developer storing portion, away from the internal surface of the developer storing portion, for reporting the developer remainder amount within the developing apparatus on the basis of the electrostatic capacity between the developer remainder amount reporting member and the development member.

25 Claims, 18 Drawing Sheets

DEVELOPING APPARATUS AND PROCESS CARTRIDGE

FIELD OF THE INVENTION AND RELATED ART

The present invention relates to a developing apparatus and a process cartridge comprising a developing apparatus.

It has been commonplace that an electrophotographic image forming apparatus which employs an electrophotographic image formation process also employs a process cartridge system. According to this system, a latent image bearing member and a processing means are integrated in the form of a cartridge removably installable in the main assembly of the image forming apparatus. The processing means includes charging means, developing means, and the like means.

Further, according to a process cartridge system, a latent image bearing member and various processing means can be maintained by users themselves; they do not need to be maintained by professional service personnel. Therefore, the employment of a process cartridge system drastically improves operational efficiency.

Thus, a process cartridge system is used in a variety of image forming apparatuses which employ an electrophotographic image formation process.

In the past, the amount of the developer remaining in a development device, that is, one of the processing means in a process cartridge, is determined by detecting the change in electrostatic capacity as illustrated in FIG. 18.

More specifically, a developer amount detecting member 205 (hereinafter, "wire antenna 205") is disposed in a development chamber, adjacent to a developer bearing member 200*c* (hereinafter, "development roller 200*c*") and squarely faces the peripheral surface of the development roller 200*c*. The amount of the developer remaining in the developer 200 is determined based on the change in the electrostatic capacity between the development roller 200*c* and wire antenna 250.

In the development device 200, the wire antenna 205 and development roller 200*c* are used as the first and second electrodes, respectively, to detect the electrostatic capacity between the two electrodes to determine the remaining amount of the developer.

In other words, when there remains a sufficient amount of developer toner in the development chamber 200*b*, an ample amount of developer is present between the two electrodes, and therefore, the electrostatic capacity between the two electrodes is relatively large.

However, as the amount of the developer between the two electrodes is reduced due to developer consumption, the electrostatic capacity between the two electrodes also reduces. Thus, the change in the electrostatic capacity is detected by a detection circuit (unillustrated) which detects the presence or absence of the developer. As the electrostatic capacity between the two electrodes falls below a predetermined level, it is determined that the remaining amount of the developer in the development device 200 has become critically small.

In recent years, however, as the image forming apparatus size has been reduced, the process cartridge size has also been required to be reduced, which created a problem. The problem is that in the development device 200 in which the wire antenna 205 is disposed adjacent to the development roller 200*c*, the clearance between the wire antenna 205 and the internal surface of the development chamber 200*b*, and the clearance between the wire antenna 205 and the development roller 200*c*, must also be reduced as the cartridge size is reduced. This makes it difficult to smoothly circulate the developer in the development device 20.

SUMMARY OF THE INVENTION

The primary object of the present invention is to provide a developing apparatus which is substantially smaller than a conventional developing apparatus, and a process cartridge which employs such a developing apparatus and is substantially smaller than a conventional process cartridge.

Another object of the present invention is to provide a developing apparatus in which a sufficient amount of space is secured adjacent to a developing member, and a process cartridge which employs such a developing apparatus.

Another object of the present invention is provide a developing apparatus in which a member for detecting the remaining amount of developer is disposed in the developer storing portion to allow the developer to smoothly move around the developing member, and a process cartridge which employs such a developing apparatus.

Another object of the present invention is to provide a developing apparatus in which developer is allowed to smoothly circulate even through the space adjacent to the developing member is small, and a process cartridge which employs such a developing apparatus.

According to an aspect of the present invention, a developing apparatus comprises a developer remainder amount detecting member which is disposed in the developer storing portion, apart from the internal surface of the developer storing portion, to detect the electrostatic capacity between itself and a developing member, based on which the remaining amount of the developer in the developing apparatus is determined, and a process cartridge which employs such a developing apparatus.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings. In the following description, the direction perpendicular to the direction in which a process cartridge is inserted into the main assembly of an image forming apparatus will be referred to as "longitudinal direction", and the direction perpendicular to "longitudinal direction" will be referred to as "width direction".

First, a preferred embodiment of the present invention will be described with reference to FIG. 1–12.

Figure 1:
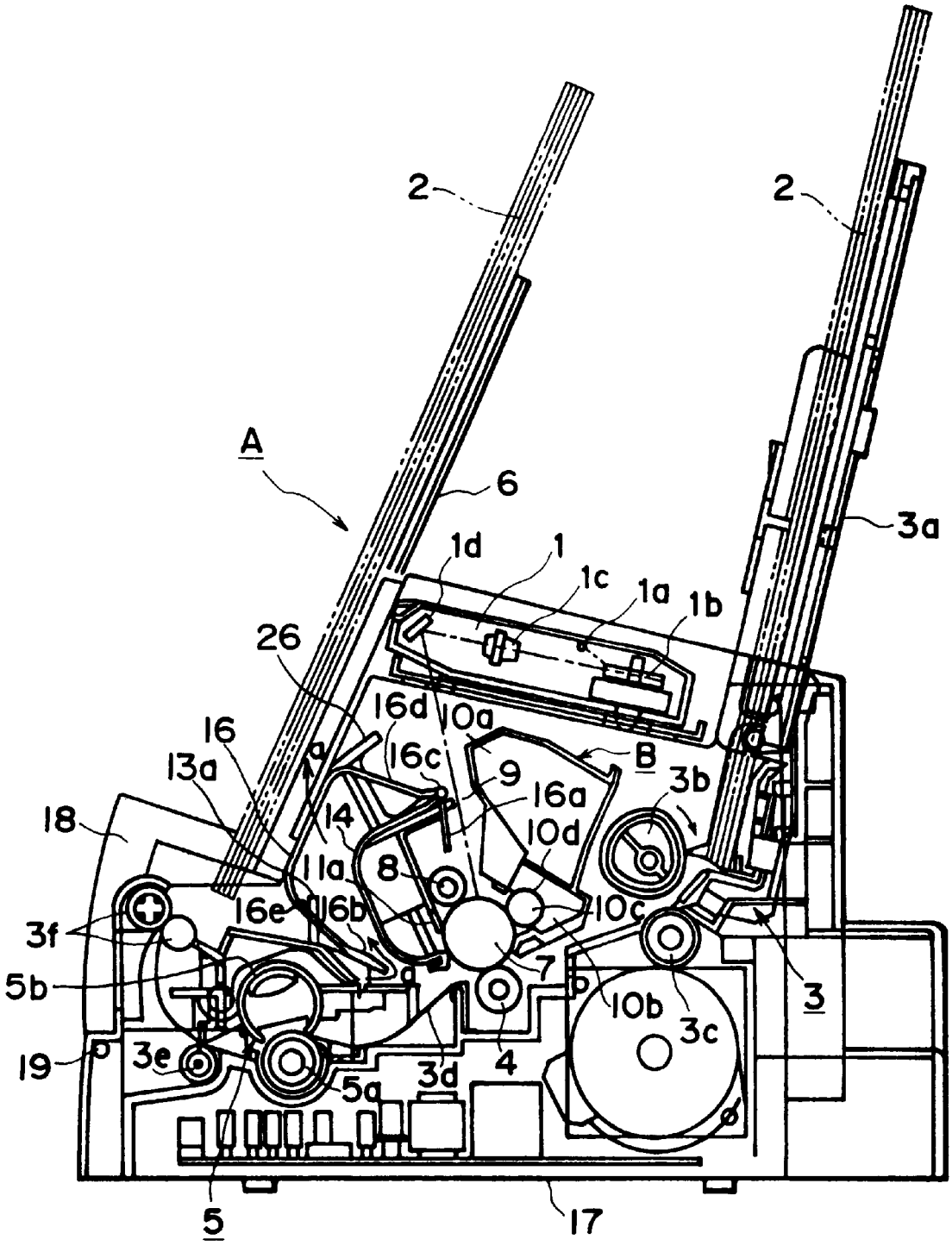
FIG. 1 is a schematic sectional view of an image forming apparatus in accordance with the present invention, and depicts the general structure thereof.

FIG. 1 is a schematic sectional view of an image forming apparatus A in accordance with the present invention, and depicts the general structure thereof. The image forming apparatus A forms an image on a piece of recording medium 2, with the use of an electrophotographic image formation process.

More specifically, first, an image is formed of toner as developer, on the peripheral surface of an electrophotographic photosensitive member 7 (hereinafter, "photosensitive drum 7") in the form of a drum.

In synchronism with the formation of the image (hereinafter, "toner image"), a piece of recording medium 2 having been stored in a feeder tray 3*a* is fed out and conveyed by a conveying means constituted of a pickup roller 3*b*, a sheet feeder roller 3*c*, and the like.

Next, the toner image formed on the photosensitive drum 7 disposed in a process cartridge B is transferred onto the recording medium 2 by applying voltage to a transfer roller 4 as an image transferring means.

The recording medium 2, onto which the toner image has been transferred, is conveyed to a fixing device 5 while being guided by a guide plate 3*d*.

The fixing device 5 is constituted of a rotative fixing member 5*b*, a pressure applying rotative member, and the like. The rotative fixing member contains a heater (unillustrated). The pressure applying rotative member conveys the recording medium 2 while pressing the recording medium against the rotative fixing member. The fixing device 5 fixes the transferred toner image to the recording medium by applying heat and pressure to the image and the recording medium.

After the fixation of the toner image to the recording medium 2, the recording medium 2 is conveyed and discharged into a delivery portion 6, being accumulated therein, by pairs of discharge rollers 3*e* and 3*b*.

Figure 2:
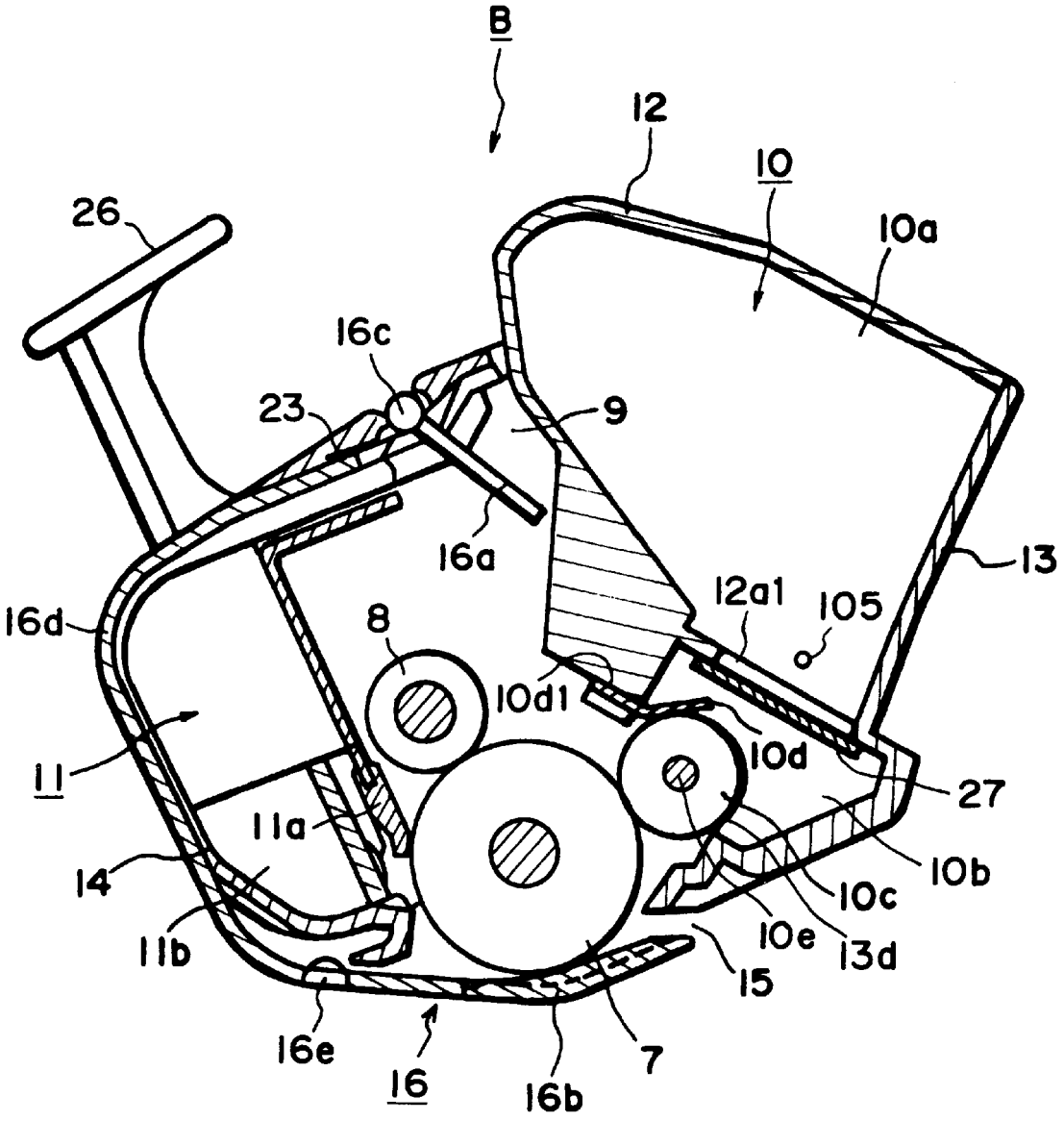
FIG. 2 is a schematic cross-sectional view of the process cartridge illustrated in FIG. 1, and depicts the general structure thereof.

Referring to FIGS. 1 and 2, in the process cartridge B, a photosensitive drum 7, the peripheral layer of which is formed of photosensitive material, is rotated so that the peripheral surface of the photosensitive drum 7 is uniformly charged by the voltage application from a charge roller 8 as a charging means.

Then, a laser beam La modulated with the image data is projected upon the peripheral surface of the photosensitive drum 7, through the exposure opening 9 of the process cartridge, from an optical system 1. As a result an electrostatic latent image is formed on the peripheral surface of the photosensitive drum 7. The electrostatic latent image is developed by a development device 10 which employs toner.

More specifically, the charge roller 8 is disposed in contact with the photosensitive drum 7, to charge the photosensitive drum 7.

The development device 10 develops the latent image formed on the photosensitive drum 7 by supplying toner to a development station, that is, the interface between the development device and the photosensitive drum 7.

To precisely describe the process, the toner is contained in the toner chamber 10*a*, which is a chamber for storing the toner as the developer, and the development device 10 supplies the toner in the toner chamber 10*a* to a development chamber 10*b*. In the development chamber 10*b*, a rotatively supported development roller 10*c*, in which a magnet (unillustrated) is fixedly disposed, is rotated so that a layer of triboelectrically charged toner is formed on the peripheral surface of the development roller 10*c* by a development blade 10*d*. From this toner layer, the toner is supplied to the aforementioned development station, or the interface between the development device and the photosensitive drum 7.

As the toner borne on the peripheral surface of the development roller 10*c* is transferred onto the peripheral surface of the photosensitive drum 7 in accordance with the latent image on the peripheral surface of the photosensitive drum 7, a toner image is formed on the peripheral surface of the photosensitive drum 7.

Next, voltage, the polarity of which is opposite to that of the toner image on the peripheral surface of the photosensitive drum 7, is applied to the transfer roller 4 to transfer the toner image onto the recording medium 2. Then, the toner remaining on the peripheral surface of the photosensitive drum 7 is removed by a cleaning means 11.

The cleaning means 11 is structured so that the toner remaining on the photosensitive drum 7 is recovered into a waste toner bin 11*b* as it is scraped away by the elastic cleaning blade 11*a*.

The photosensitive drum 7, charge roller 8, and the like are integrally disposed in a cartridge, constituting a process cartridge B. The cartridge is constituted of a toner chamber portion 13 and a cleaning chamber portion 14.

More specifically, the toner/development chamber shell 12 is welded to the toner/development chamber shell cover 13 to form the toner chamber 10*a* and development chamber 10*b*. Then, the development roller 10*c*, the development blade 10*d*, and the like are attached in the development chamber 10*b*.

On the other hand, the photosensitive drum 7, charge roller 8, cleaning means 11, and the like are attached in the cleaning chamber portion 14.

Then, the toner/development chamber shell 12 and the cleaning chamber shell 14 are pivotally joined to complete the process cartridge B.

The process cartridge B is provided with the exposure opening 9, a transfer opening 15, and the like. The exposure opening 9 is an opening through which the laser beam La modulated with the image data is projected onto the peripheral surface of the photosensitive drum 7, and the transfer opening 15 is an opening through which the peripheral surface of the photosensitive drum 7 squarely faces the recording medium 2. The process cartridge B is also provided with a shutter 16 for exposing or covering the openings 9 and 15.

The transfer opening 15 constitutes an opening through which a toner image formed on the photosensitive drum 7 is transferred onto the recording medium 2.

Figure 4:
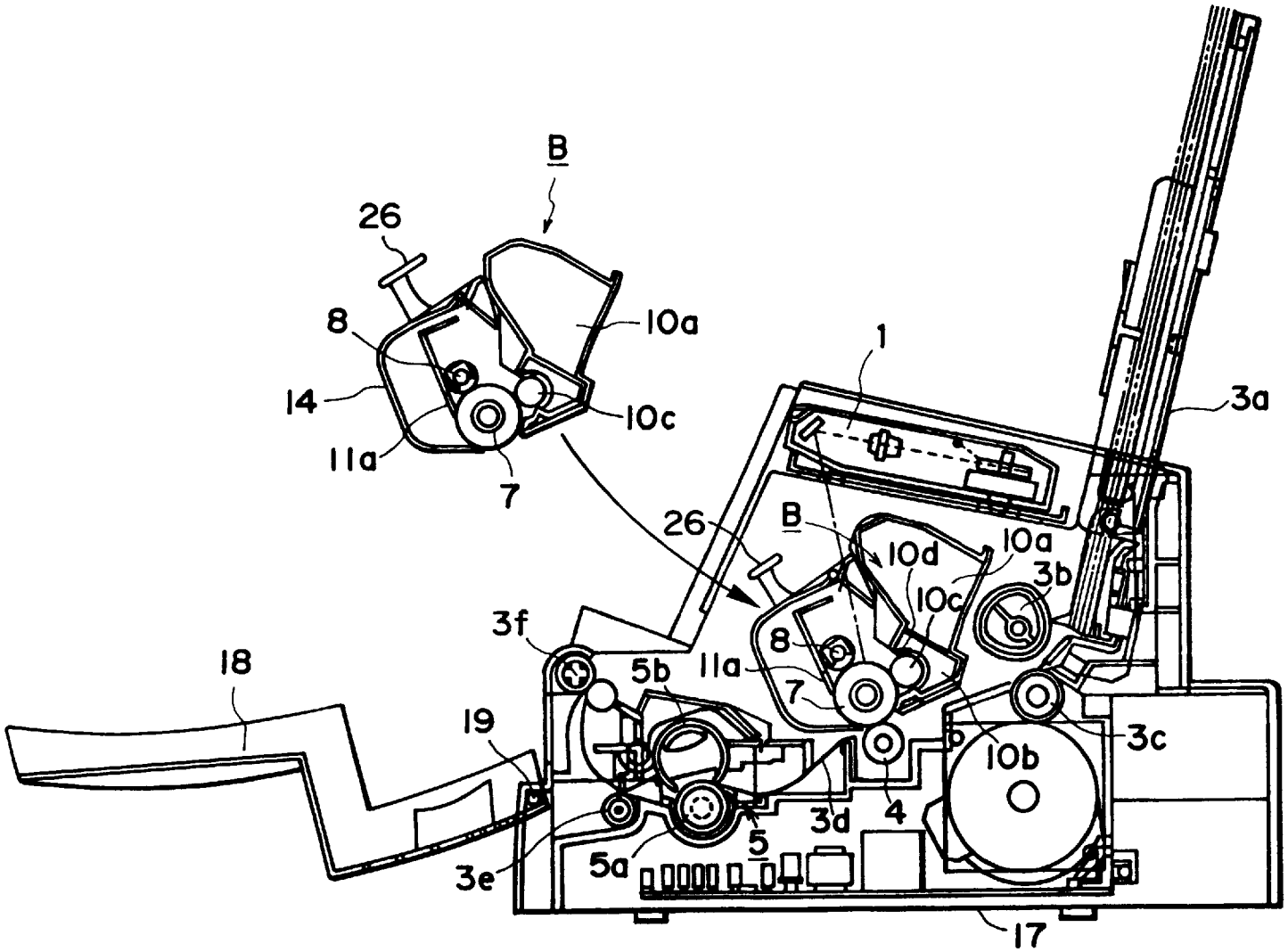
FIG. 4 is a schematic sectional view of the image forming apparatus illustrated in FIG. 1, and depicts the method for installing or removing the process cartridge illustrated in FIG. 1.

Referring to FIG. 4, an image forming apparatus A is provided with a cover 18, which is attached to the main assembly 17 (hereinafter, "apparatus main assembly 17") of the image forming apparatus A, being allowed to freely pivot about a shaft 19. In the internal space of the apparatus main assembly 17 exposable by opening the cover 18, there are a pair of grooves, which constitute guide rails (FIG. 12) for guiding the process cartridge B into the space.

Figure 3:
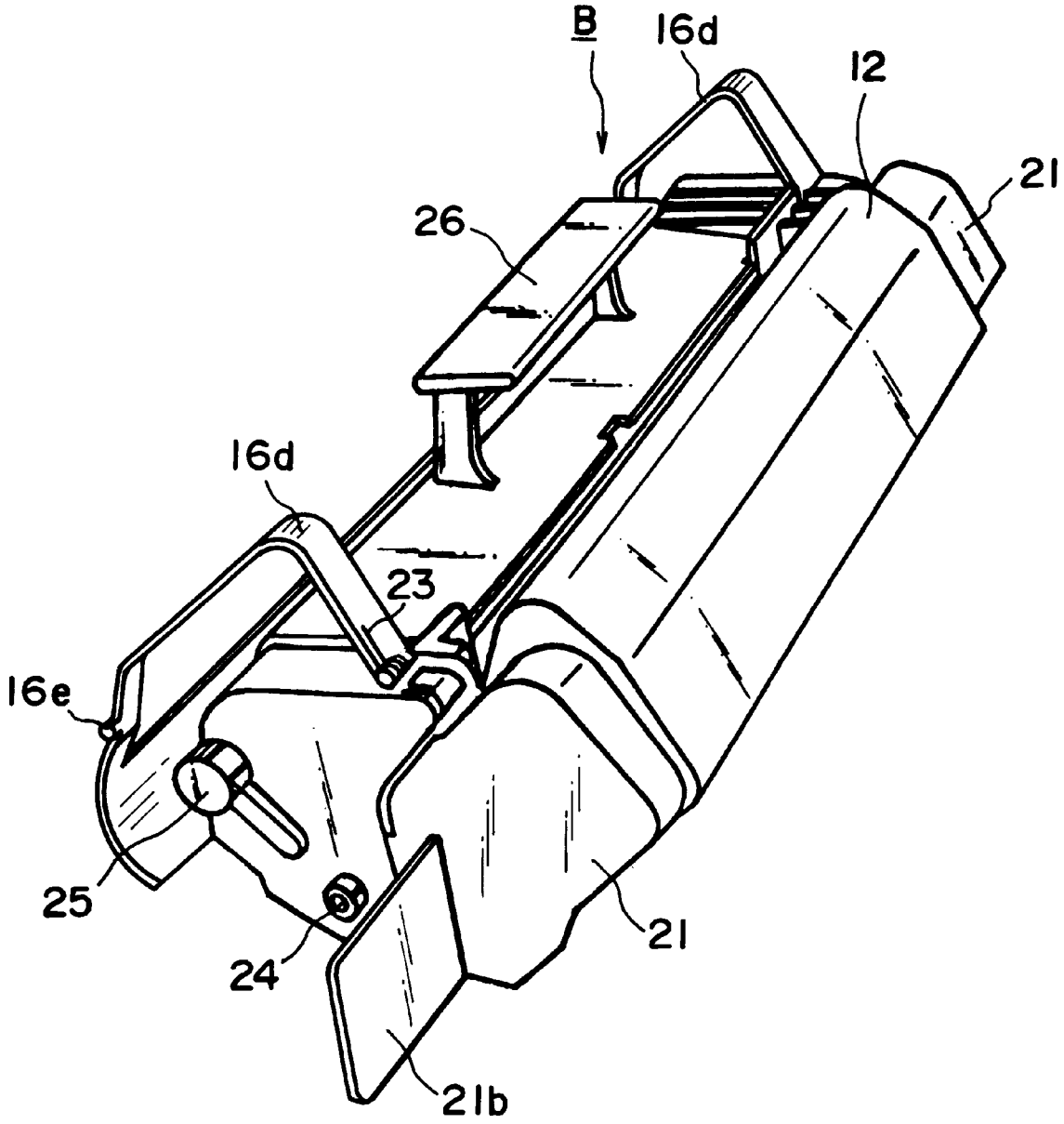
FIG. 3 is a perspective view of the process cartridge illustrated in FIG. 2, and depicts the general structure thereof.

In other words, in this embodiment, the process cartridge B is installed or removed by a user along the grooves 150. During the installation and removal of the process cartridge B, the first and second projections 24 and 25 provided on each of the longitudinal ends of the process cartridge B as illustrated in FIG. 3 are guided by the grooves 150 of the apparatus main assembly 17.

Next, referring to FIGS. 5–9, the general structure of the shell, which constitutes the frame structure of the development device 10 will be described.

Figure 5:
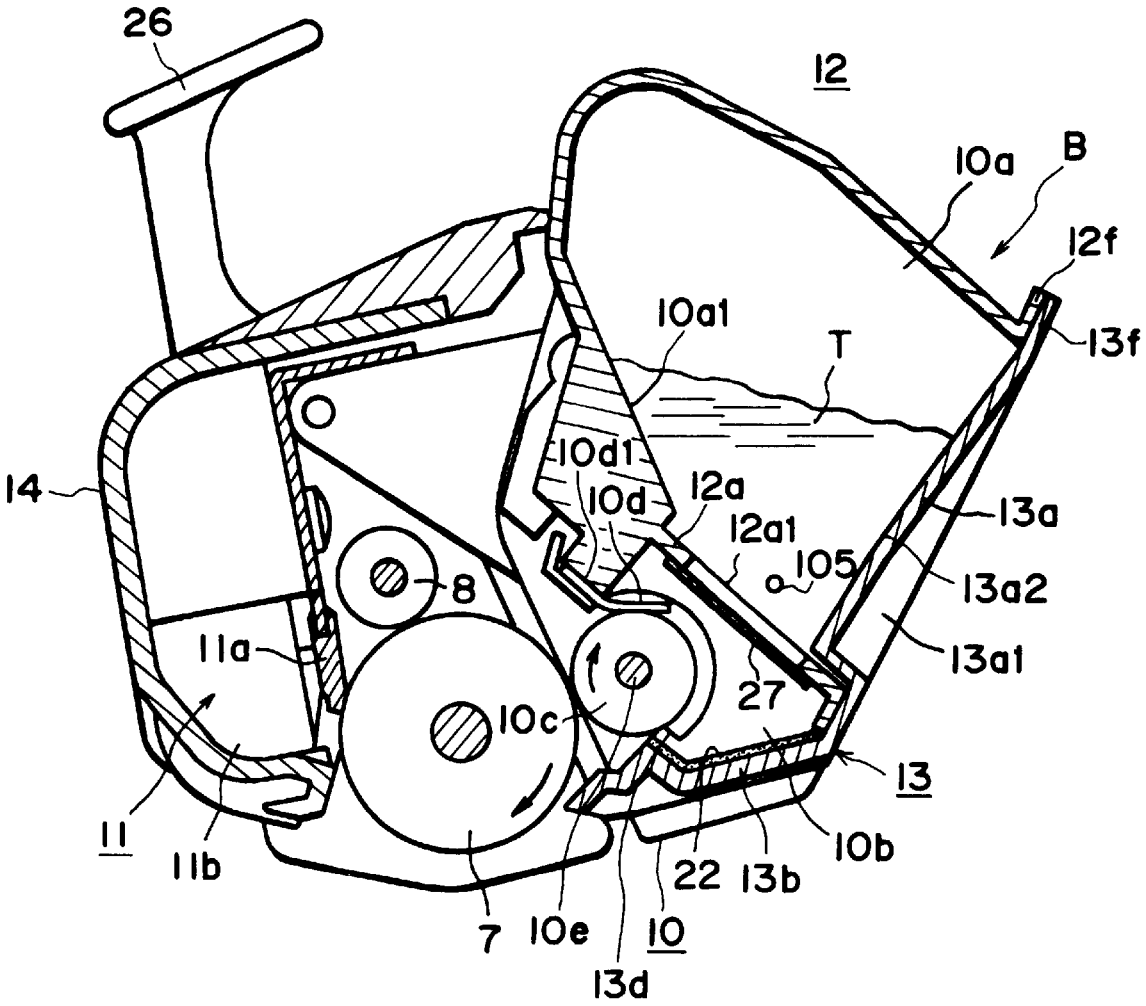
FIG. 5 is a cross-sectional view of the process cartridge illustrated in FIG. 2, and depicts the state of the developer stored in the development device.
Figure 6:
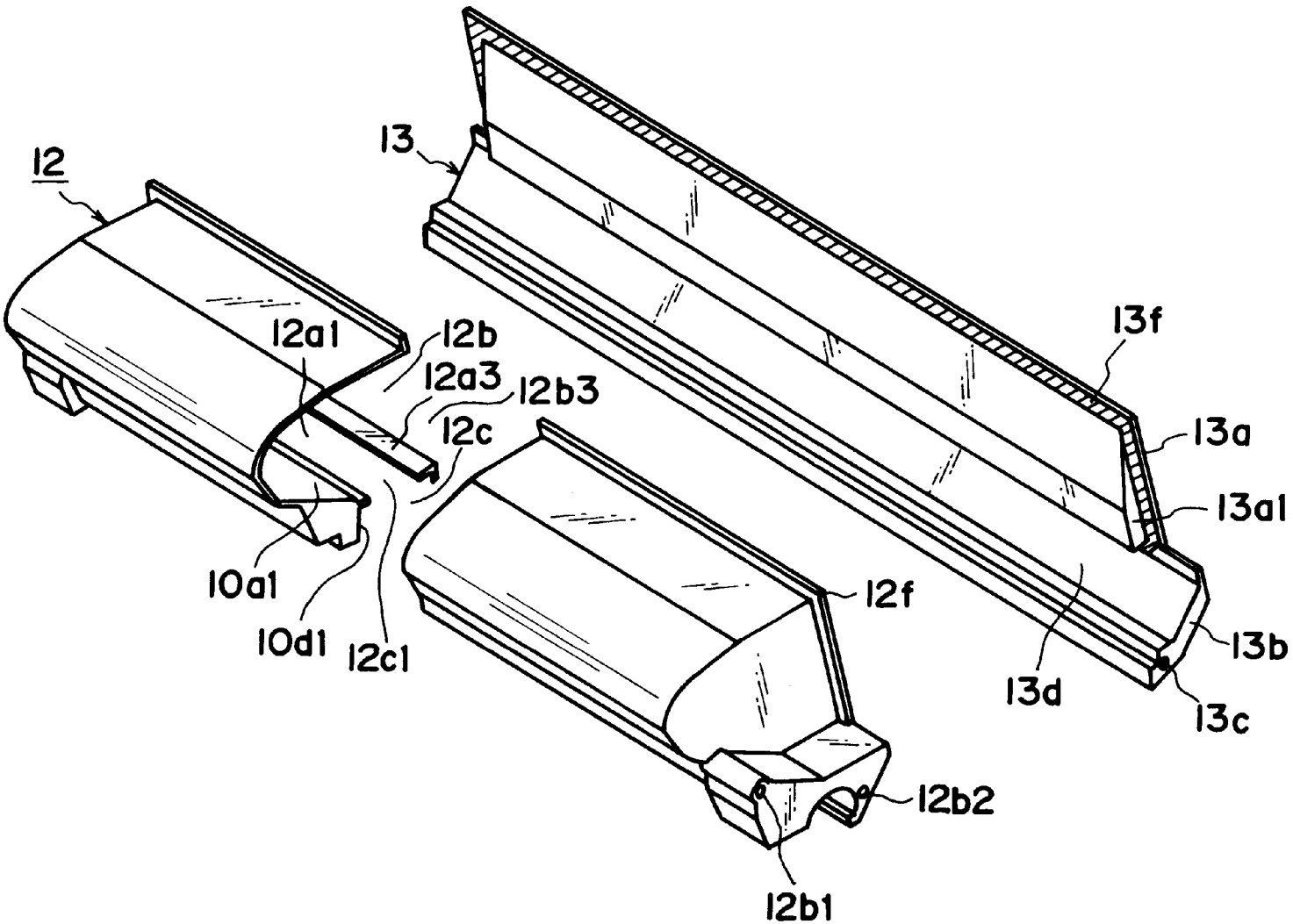
FIG. 6 is a perspective view of the process cartridge illustrated in FIG. 2, in the state in which the toner/developer chamber shell and the cover for the toner/development chamber shell are separated from each other.

Referring to FIGS. 5 and 6, the development device 10 comprises the toner chamber 10*a* and development chamber 10*b* formed by joining the toner/development chamber shell 12 and the toner/development chamber cover 13.

The toner/development chamber shell 12 is the main component for forming the toner chamber 10*a* and development chamber 10*b*. The shell 12 comprises a toner chamber portion 12*b* for creating the toner chamber 10*a*, a development chamber portion 12*c* for creating the development chamber 10*b*, and a seal attachment portion 12*a* which is between the toner chamber portion 12*b*, or the top portion, and the development chamber portion 12*c*, or the bottom portion.

On the other hand, the toner/development chamber cover 13 is structured to be joined with the toner/development chamber shell 12 to cover the opening of the toner/development chamber shell 12. The toner/development chamber cover 13, which is a single piece component, comprises a toner chamber cover portion 13*a* and a development chamber cover portion 13*b*, which are attached to the toner/development chamber shell 12, across the toner chamber portion and development chamber portion, respectively.

Figure 7:
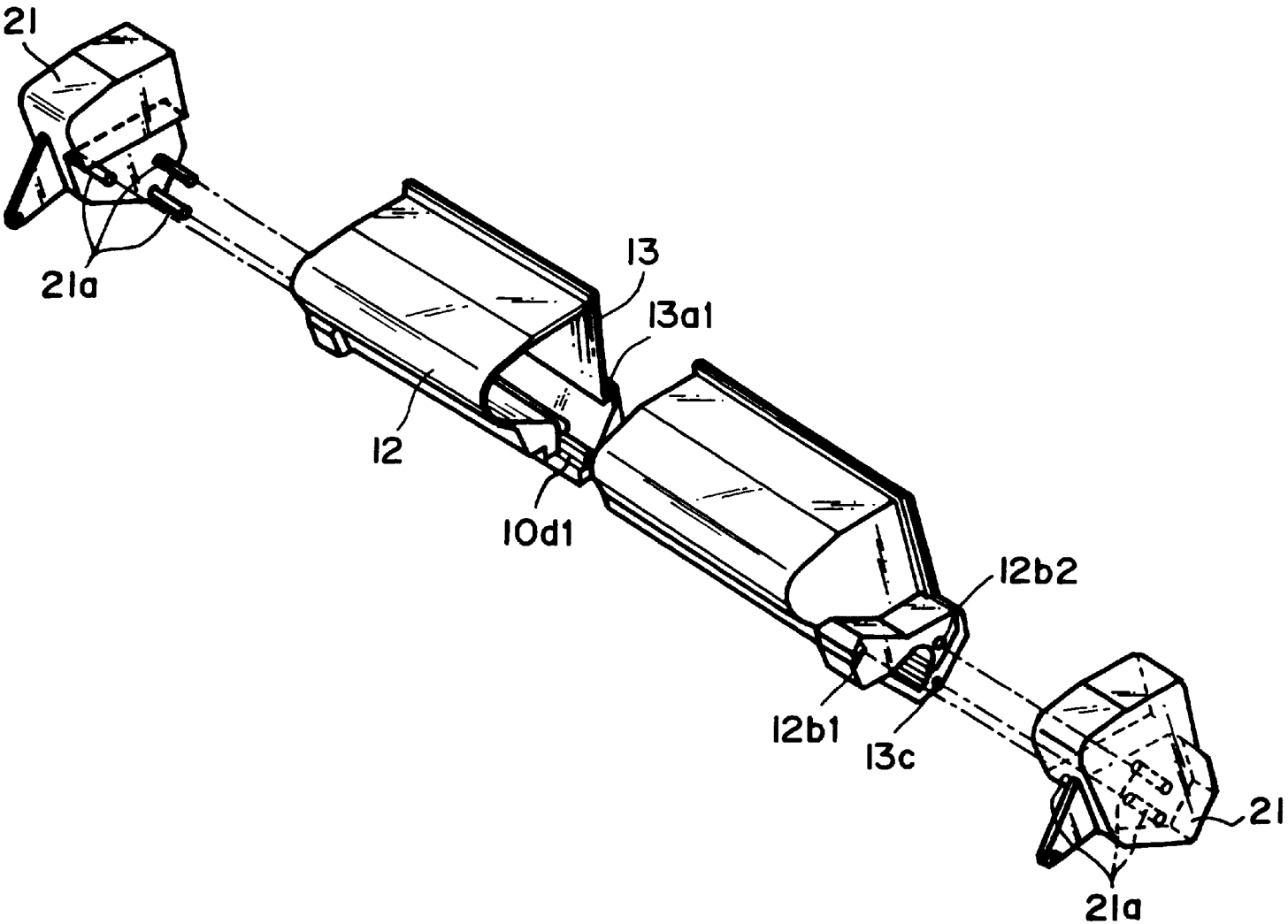
FIG. 7 is a perspective view of the toner/development chamber shell and the toner/development chamber sell cover illustrated in FIG. 6, and depicts how the two structures are joined.

Referring to FIG. 7, the longitudinal end member 21 functions as a member for accurately positioning the development roller 10*c* relative to the toner/development shell 12 when the roller 10 is attached to the shell 12, and also as a member for accurately positioning the cleaning chamber shell 14 relative to the toner/development chamber shell 12 when the cleaning chamber shell 14 is joined with the toner/development chamber shell 12.

Figure 9:
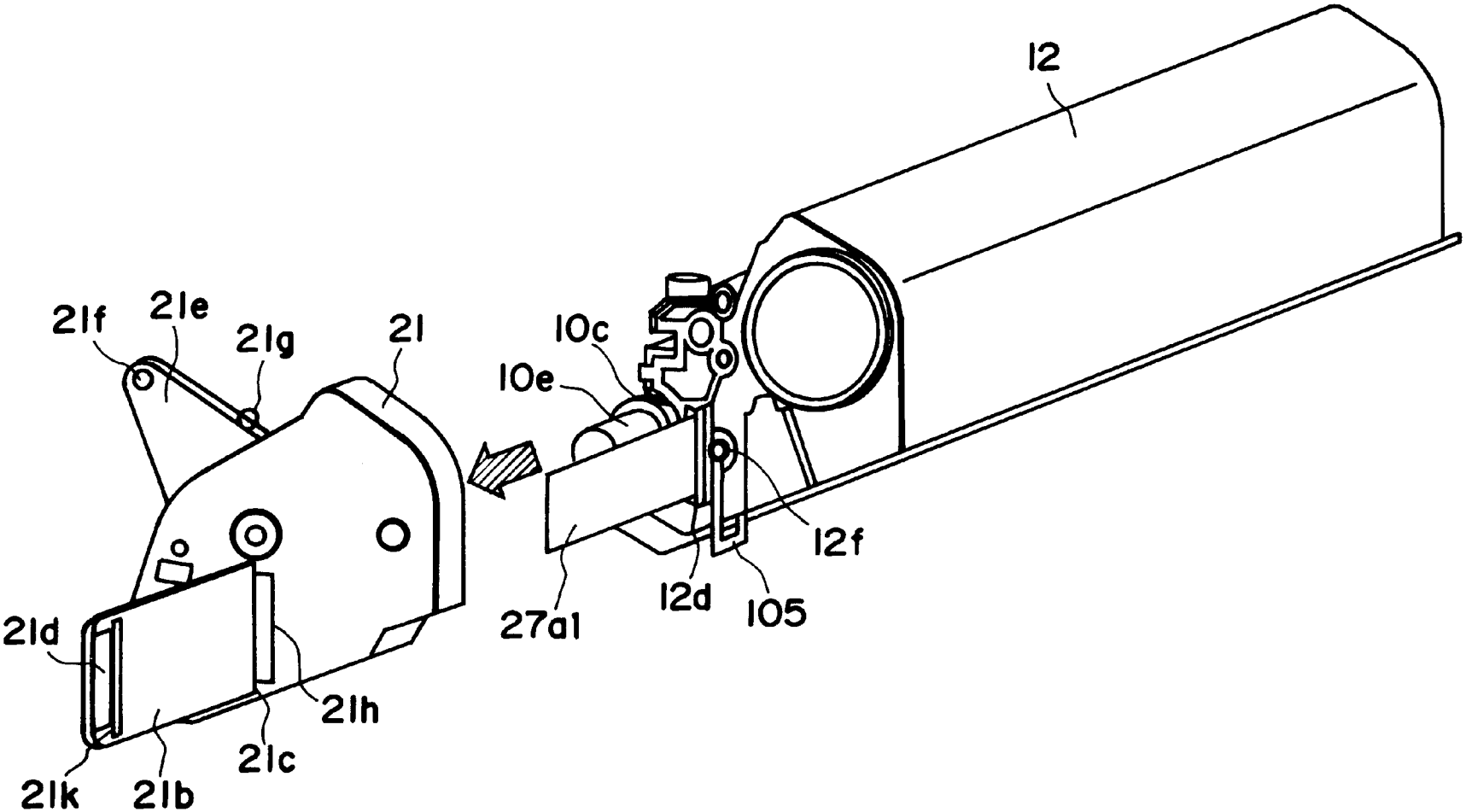
FIG. 9 is a partially disassembled perspective view of the main structure of the toner/development chamber shell, and depicts how the main structure and the end piece of the toner/development chamber shell are joined.

Next, referring to FIG. 9, the longitudinal end member 21 is provided with an arm 21*e* which extends toward the cleaning chamber shell 14. The end portion of the arm 21*e* is provided with a hole 21*f* which extends in the longitudinal direction of the process cartridge B, and the cleaning chamber shell 14 is provided with a hole (unillustrated) correspondent to the hole 21*f*. The cleaning chamber shell 14 is joined with the toner/development chamber shell 12 by putting a pin (unillustrated) through these holes. There is disposed a compression spring (unillustrated) between the shells 12 and 14 so that a development space ring (unillustrated) fitted around each longitudinal end portion of the development roller 10*c* and the photosensitive drum 7 are pressed against each other by the elasticity of the compression spring.

The toner chamber 10*a* of the development device 10 is filled with toner through a toner filling opening (unillustrated) after the toner supplying opening 21*a*1 is sealed with a toner seal 27, which is glued to the rim portion of the toner supplying opening 12*a*1. After the filling of the toner, the toner filling opening is sealed with a cap (unillustrated). Then, the development roller 10*c* and development blade 10*d* are disposed in the development chamber 10*b* to complete the development device 10.

In other words, the assembly of the process cartridge B is completed by joining the cleaning chamber shell 14, to which the photosensitive drum 7, cleaning means 11, and the like have been attached, with the toner/development chamber portion, created through the integration of the toner/development chamber shell 12 and the toner/development chamber cover 13.

As is evident from the above description and FIG. 5, the toner/development chamber shell 12 is structured so that during the assembly of the process cartridge B, the toner chamber 10*a* is positioned on the top side of the development chamber 10*b*, and also so that a portion of the toner chamber 10*a* extends toward the photosensitive drum 7 side beyond the development chamber 10*b*.

Figure 8:
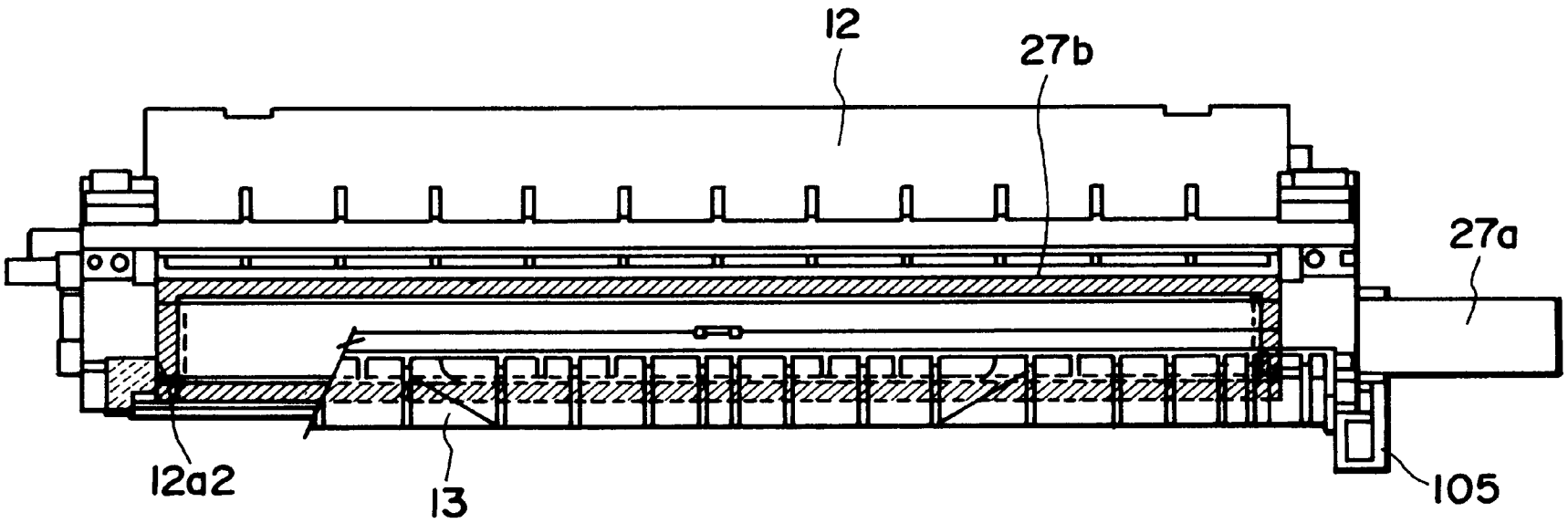
FIG. 8 is a sectional view of the toner/development chamber shell illustrated in FIG. 6, and depicts the placement of a toner seal relative to the toner/development chamber shell.

Next, the general structure of the toner seal 27 in this embodiment will be described. FIG. 8 is a drawing for describing the attachment of the toner seal 27 to the toner/development chamber shell 12.

As illustrated in FIG. 8, a cover film 27*b*, which is easy to tear in the longitudinal direction, is pasted to the seal attachment portion 12*a*, sealing the toner supplying opening 12*a*1 of the toner/development chamber shell 12 (FIG. 5).

More specifically, the cover film 27*b* in this embodiment is pasted to the seal attachment portion 12*a*, along the four edges of the toner supplying opening 12*a*1.

The cover film 27*b* is provided with a tear tape 27*a*, which is welded to the cover film 27*b* to be used for unsealing the toner supplying opening 12*a*1. The tear tape 27*a* is placed across the toner supplying opening 12*a*1 from one of the longitudinal ends 12*a*2 to the other, is folded back at the other end, and is extended outward through a hole 12*d* provided at the first longitudinal end of the process cartridge B.

Thus, in the case of this embodiment, as the portion of the tear tape 27*a,* which is extended from one of the longitudinal ends of the process cartridge B is pulled, a portion of the cover film 27*b* is torn by the tear tape 27*a,* and is pulled out of the process cartridge B through the hole 12*d* along with the tear tape 27*a,* unsealing the toner supplying opening 12*a*1 of the toner/development chamber shell 12. As a result, the toner can be sent out from the toner chamber 10*a* into the development chamber 10*b.*

Next, referring to FIGS. 10–12, the general structure of an antenna-like member 105 (hereinafter, "wire antenna") for detecting the remaining amount of the toner in the development chamber 12*b* will be described.

Figure 11:
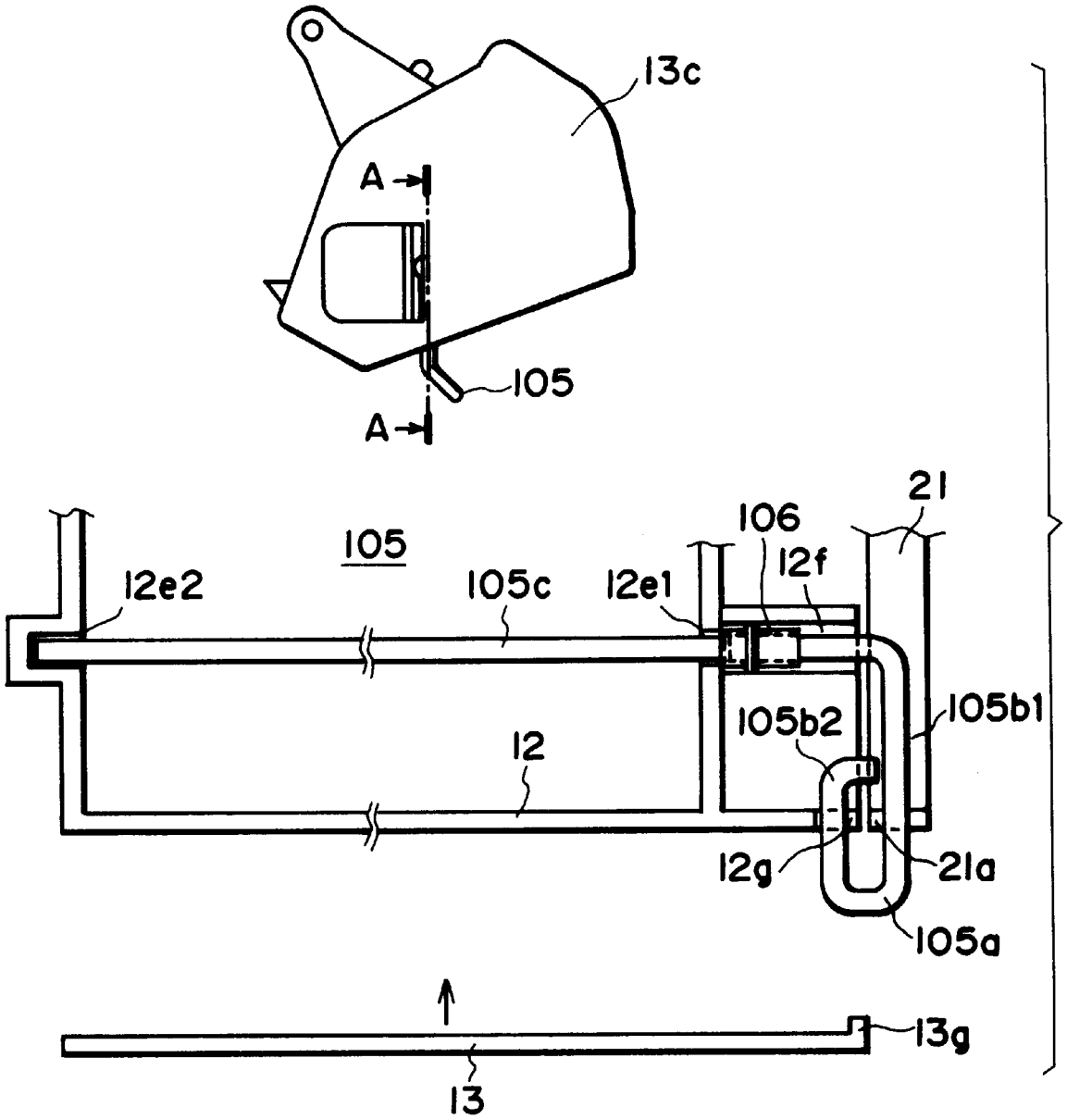
FIG. 11 is a schematic drawing which depicts the configuration of the wire antenna illustrated in FIG. 2.
Figure 12:
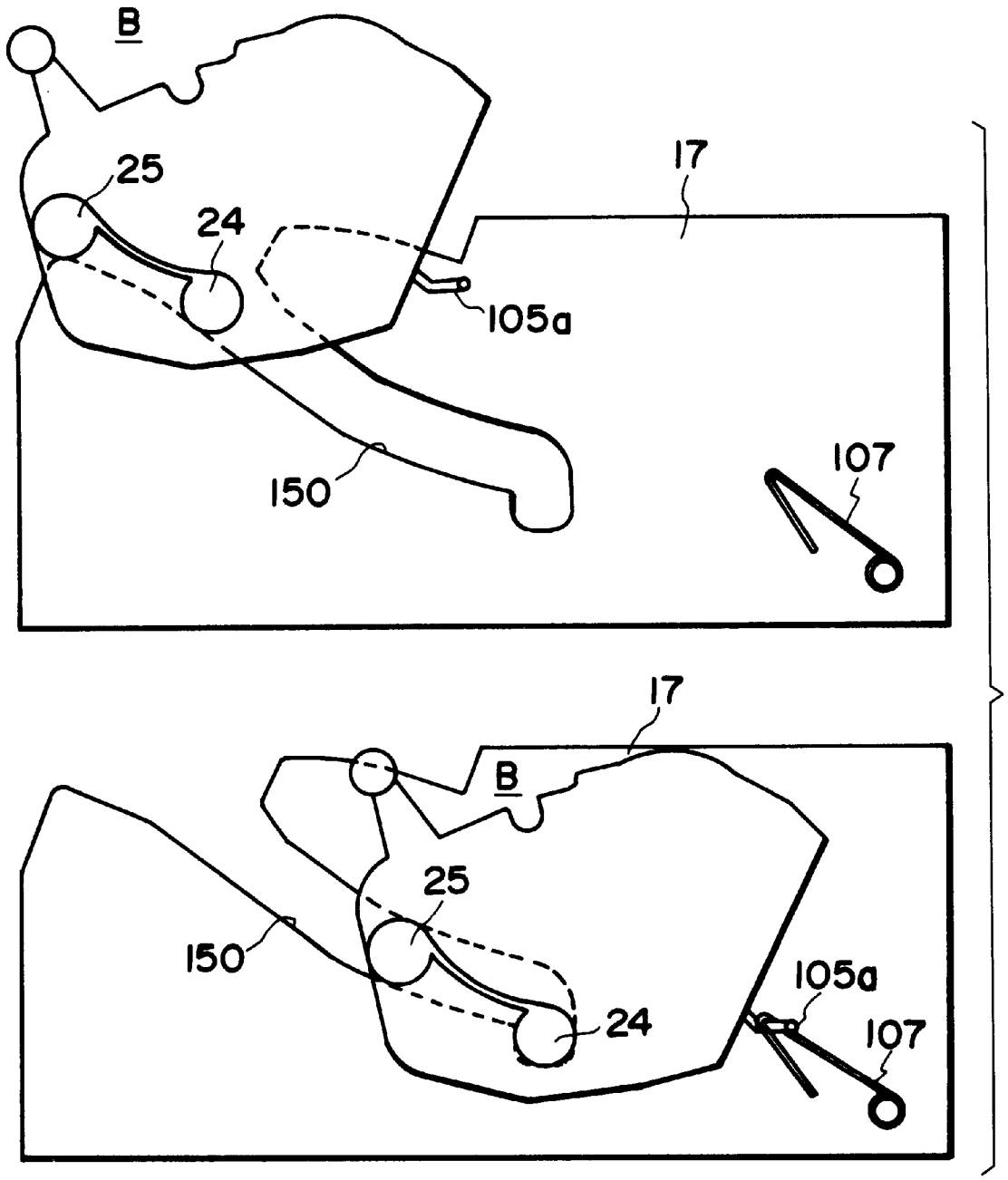
FIG. 12 is a schematic drawing which depicts how the contact terminal of the wire antenna comes in contact with the contact terminal on the image forming apparatus side as the process cartridge illustrated in FIG. 2 is installed into the main assembly of the image forming apparatus.

As illustrated in FIGS. 11 and 12, a reference character 105 designates a wire antenna as the developer-remainder-amount detecting member disposed in the toner chamber 10*a,* being fixed to the toner/development chamber shell 12 substantially in parallel to the development roller 10*c.*

Thus, in this embodiment, the wire antenna 105 and the development roller 10*c* are caused to function as the first and second electrodes, respectively, and as development bias to applied to the development roller 10*c,* the change in the electrostatic capacity between the two electrodes can be detected.

The wire antenna 105 in this embodiment is constituted of a piece of nonmagnetic stainless steel wire with a diameter of approximately 2 mm. It comprises a detecting portion 105*c,* first and second crank-like portions 105*b*1 and 105*b*2, a contact portion 105*a,* and the like. The detecting portion 105*c* is located within the toner/development chamber shell 12 to detect the presence or absence of the toner, and the first and second crank-like portion 105*b*1 and 105*b*2 are located outside the toner/development chamber shell 12, being engaged with the shell and the end portion to prevent the wire antenna 105 from rotating. The contact portion 105*a* is the portion between the two crank-like portions 105*b*1 and 105*b*2, and is placed in contact with the wire antenna contact portion 107 of the apparatus main assembly 17.

Thus, in this embodiment in which the wire antenna 105 is disposed in the toner chamber 10*a,* as the toner seal 27 is broken, the toner stored in the toner chamber 10*a* is supplied by its own weight into the development chamber 10*b* through the toner supplying opening 12*a*1. Then, the toner is attracted toward the development roller 10*c* by the magnetic force from the magnet fixedly disposed within the development roller 10*c,* and is smoothly circulated in the development chamber 10*b* in the rotational direction of the development roller 10*c.*

Since the toner supplied into the development chamber 10*b* is circulated in the rotational direction of the development roller 10*c* as described above, the development roller 10*c* is constantly supplied with the toner. As the toner is circulated in the development chamber 10*c,* a portion of the toner is passed between the development roller 10*c* and the development blade 10*d,* being thereby triboelectrically charged, and is conveyed to the development station, that is, the interface between the development roller 10*c* and the photosensitive drum 7.

As the toner in the development chamber 10*b* is consumed, the toner will be present only adjacent to the bottom surface of the development chamber 10*b* and the development roller 10*c,* although it will still be circulated as described above. As the toner is further consumed, the size of the area in which the toner is circulated becomes so small that the electrostatic capacity between the development roller 10*c* and wire antenna 105 changes. The remaining amount of the toner can be determined by detecting this change.

An increase in the distance between the wire antenna 105 and development roller 10*c* reduces the output of the toner remainder amount detecting member. In this embodiment, however, the size of the development chamber 10*b* is reduced, and also, the toner supplying opening 12*a*1 is positioned closer to the development roller 10*c*. Therefore, the change in the electrostatic capacity between the two electrodes can be satisfactorily detected even through the wire antenna 105 is disposed within the toner chamber 10*a*.

It has been known through experiments that in order for the change in the electrostatic capacity between the two electrodes to be satisfactorily detected without interfering with the toner circulation adjacent to the development roller 10*c,* the wire antenna 105 is desired to be disposed within the toner chamber 10*a,* and no more than 20 mm away from the peripheral surface of the development roller 10*c* (FIG. 5).

Figure 10:
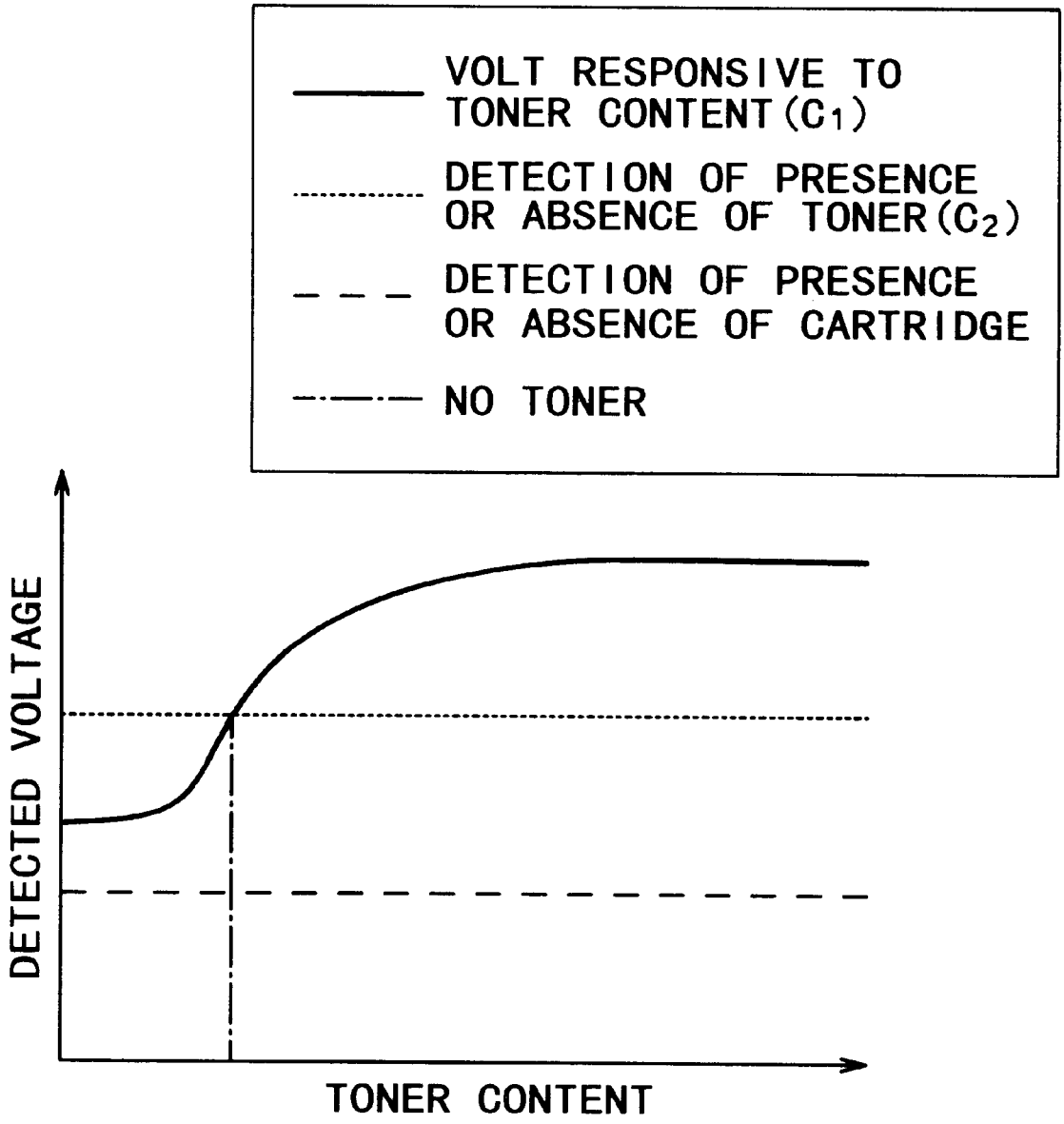
FIG. 10 is a graph which shows the relationship between the electrostatic capacity between the development roller illustrated in FIG. 2, and the output voltage of the wire antenna.

FIG. 10 is a graph that depicts the relationship between the electrostatic capacity between the two electrodes and the amount of the toner in the toner chamber 10*a*. The abscissa and ordinate represent the toner remainder amount and detected voltage, respectively.

As is evident from FIG. 10, when the toner is present in an ample amount between the two electrodes, the electrostatic capacity between the two electrodes is large, whereas as the amount of the toner present between the two electrodes is reduced, the electrostatic capacity also is reduced.

Thus, the change in the electrostatic capacity between the two electrodes is detected by a toner-remainder detection circuit (unillustrated) built in as a part of the apparatus main assembly 17, and as the voltage detected by a toner-remainder detection circuit becomes smaller than a predetermined voltage, it is determined that there is no toner, and a user is informed through a display portion (unillustrated) of the apparatus main assembly 17 that the development device has run out of toner.

Referring to FIGS. 11 and 12, a reference character 12*e*1 designates a first hole provided through the side wall of the toner/development chamber shell 12.

The first hole 12*e*1 is surrounded by a circular hole 12*f*, the center of which coincides with the center of the first hole 12*e*1. The hole designated with the reference character 12*e*2 is a second hole located in the inward side of one of the lateral walls of the toner/development chamber shell 12. It is squarely faced toward the first hole 12*e*1.

The second hole 12*e*2 is a blind hole; the second hole does not penetrate the side wall.

The diameter of the wire antenna 105 in this embodiment is set so that the wire antenna 105 exactly fits in the first and second holes 12*e*1 and 12*e*2. One end of the wire antenna 105 is provided with a contact portion 105*a*, which projects out of the toner/development chamber shell 12.

A reference character 106 designates a wire antenna seal in the form of a ring, which is an elastic member formed of mainly rubber or the like material. In this embodiment, the external diameter of the wire antenna seal 106 is rendered larger than the diameter of the hole 12*f*, and the diameter of the wire antenna 105 is set to be larger than the diameter of the internal edge of the wire antenna seal 106.

In assembling the process cartridge B in this embodiment, the wire antenna seal 106 is pressed into the hole 12*f* of the toner/development chamber shell 12, and one end of the wire antenna 105 is put through the wire antenna seal 106 and the first hole 12*e*1 of the toner/development chamber shell 12 in this order. Then, it is fitted into the second hole 12*e*2, so that the wire antenna 105 is accurately positioned relative to the development roller 10*c*.

Next, the other end of the wire antenna 105, that is, the portion with the second crank-like portion 105*b*2 is fitted in the groove 12*g* of the toner/development chamber shell 12, and the longitudinal end member 21 is attached to the toner/development chamber shell 12. When the longitudinal end member 21 is attached to the toner/development chamber shell 12, the first crank-like portion 105*b*1 of the wire antenna 105 is fitted in the groove 21*a* of the longitudinal end member 21, so that the wire antenna 105 is prevented from rotating, and the contact portion 105*a* is accurately positioned.

Prior to the attachment of the longitudinal end member 21, in order to prevent the wire antenna 105 from slipping out, the toner/development chamber shell cover 13 is welded to the toner/development chamber shell 12 after the attachment of the wire antenna 105 to the toner/development chamber shell 12. As a result, a projection 13*g* of the toner/development chamber shell cover 13 fits between the first and second crank-like portions of the wire antenna 105, preventing the wire antenna 105 from slipping out.

In FIG. 12, a reference character 17 designates a wire antenna contact portion on the apparatus main assembly 17 side, which is connected to the circuit board (unillustrated) on the apparatus main assembly 17 side to transmit the voltage detected by the wire antenna 105 to the toner remainder amount detection circuit of the apparatus main assembly 17.

The electrical connection between the wire antenna contact portion 107 and the contact portion 105*a* is established as a user inserts the process cartridge B into the apparatus main assembly 17 by fitting the first and second projections 24 and 25 provided on the longitudinal end wall of the process cartridge b, into the grooves 150 of the apparatus main assembly 17, and the wire antenna contact portion 107 is flexed by the contact portion 105*a*.

With the use of the structural arrangement in this embodiment described above, the wire antenna 105 can be disposed within the toner chamber 10*a*, that is, where it does not interfere with the toner circulation within the development chamber 10*b*. In other words, the amount of the remaining toner can be reliably detected without interfering with the toner circulation within the development chamber 108 in spite of the reduction in the size of the development device or the like. Therefore, the problem that even when there is a sufficient amount of the toner in the development chamber 10*c*, the development roller 10*c* is not supplied with a sufficient amount of the toner due to the interference to the toner circulation, does not occur; an image which does not suffer from the presence of abnormal white spots can be produced.

Reference Modifications

Next, referring to FIGS. 13 and 14, another embodiment of the present invention will be described. The general structure of the image forming apparatus in this embodiment is the same as that in the preceding embodiment illustrated in FIGS. 1 and 4. Therefore, its description will be omitted.

Figure 13:
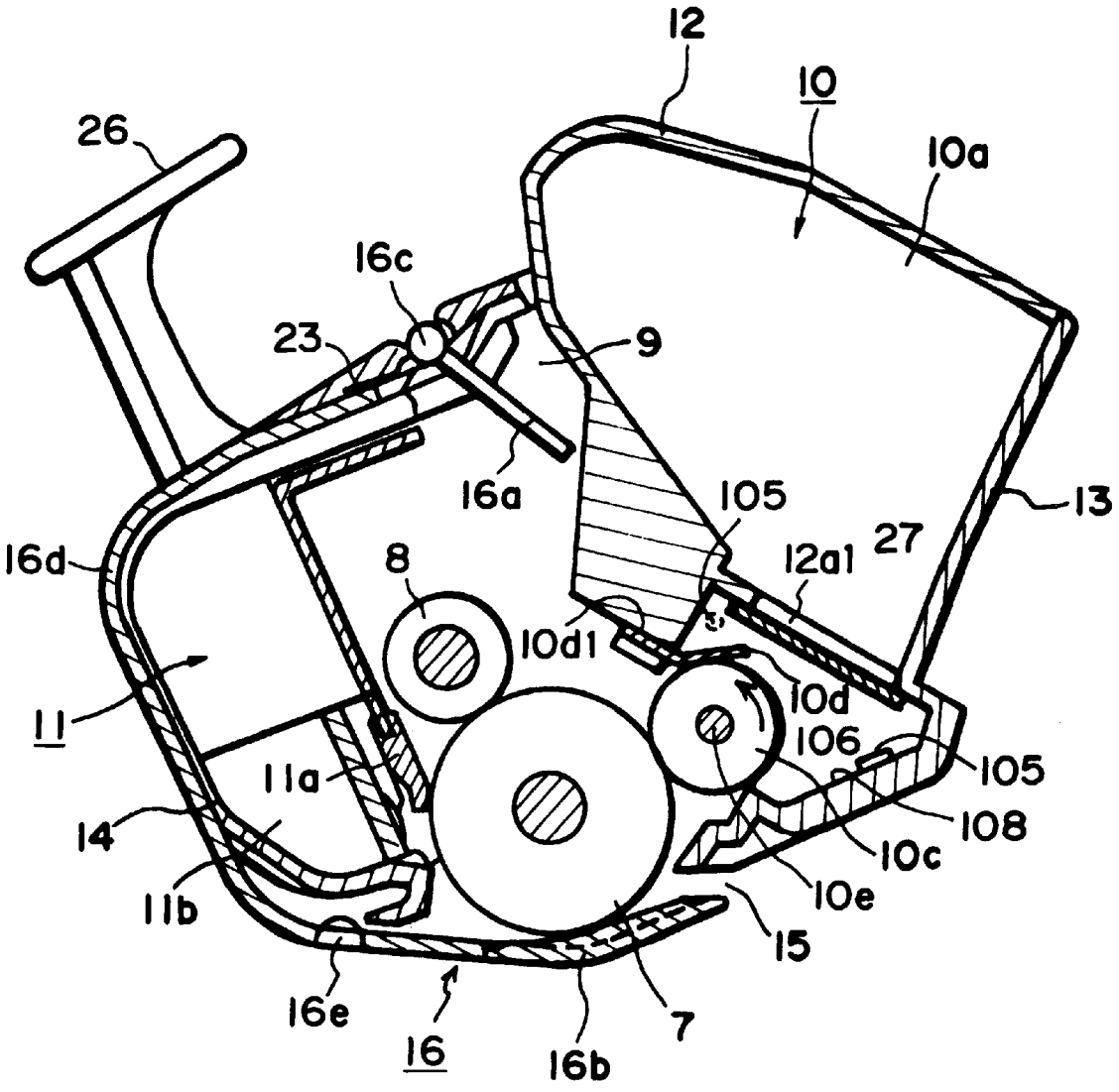
FIG. 13 is a cross-sectional view of the process cartridge in another embodiment, and depicts the general structure thereof.
Figure 14:
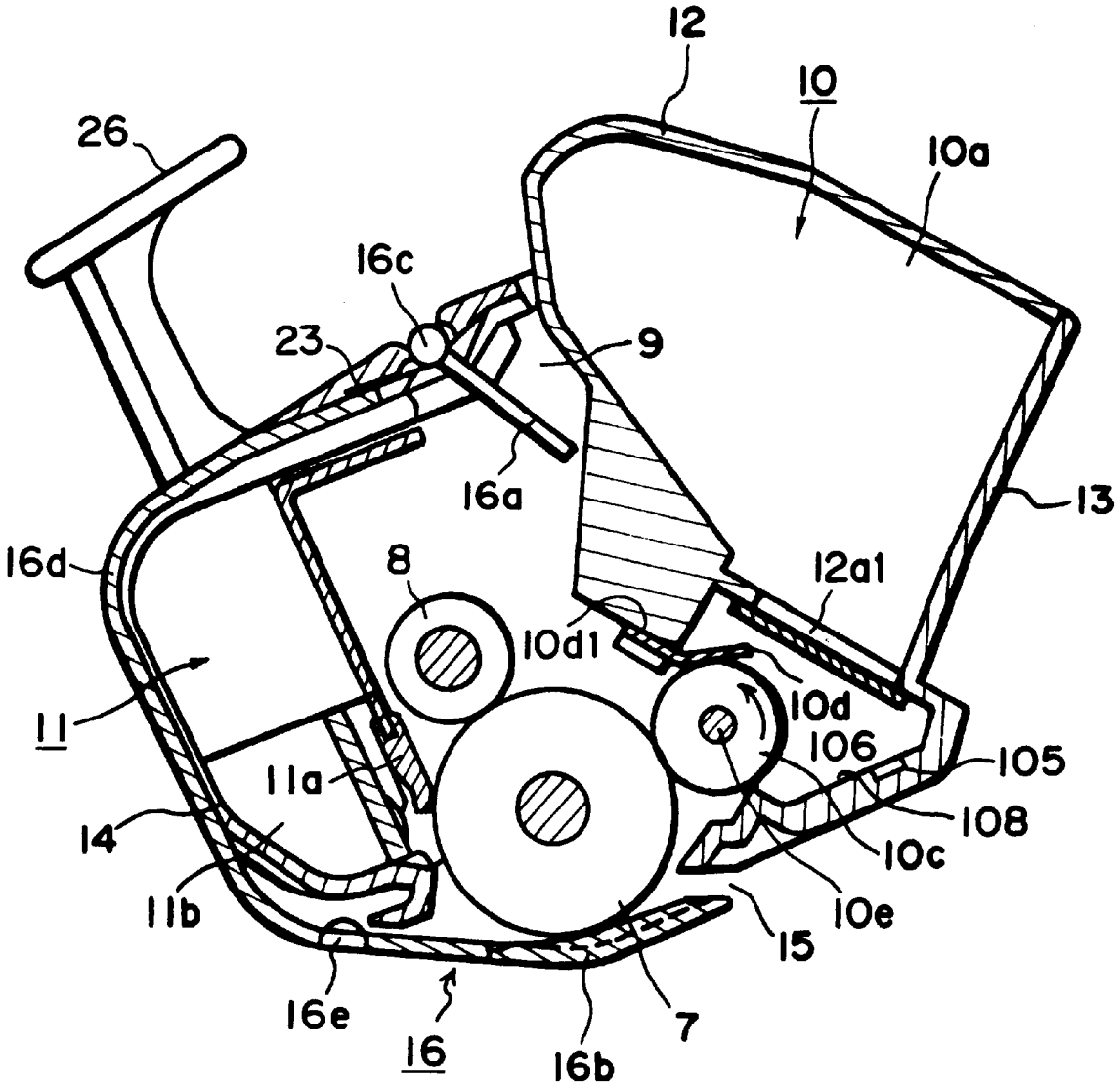
FIG. 14 is a cross-sectional view of the process cartridge in another embodiment, and depicts the general structure thereof.

FIGS. 13 and 14 are sectional views of the process cartridge in this embodiment, and show the location of the wire antenna 105.

Referring to FIG. 13, the wire antenna 105 is disposed within the development chamber 10*c*, in contact with the bottom surface 108 of the development chamber 10*b*.

Also in this embodiment, as the toner seal 27 is broken, the toner having been stored in the toner chamber 10*a* is supplied into the development chamber 10*b* through the toner supplying opening 12*a*1, is attracted to the development roller 10*c* by the magnetic force from the magnet sealed in the development roller 10*c*, and is circulated within the development chamber in the rotational direction of the development roller 10*c*.

Since the wire antenna 105 in this embodiment is disposed in the development chamber 10*b*, in contact with the bottom surface 108 of the development chamber 10*b*, the toner is smoothly circulated.

As the toner within the development chamber 10*b* is consumed, the remaining toner tends to collect adjacent to the bottom surface 108 of the development chamber 10*b* and the development roller 10*c*. therefore, in the case of this embodiment in which the wire antenna 105 is disposed in contact with the bottom surface 108 of the development chamber 10*b*, the output which reflects the electrostatic capacity between the development roller 10*c* and the wire antenna 105, which represents the presence or absence of the toner, must be detected with an accuracy slightly higher than in the case of a conventional antenna arrangement.

Thus, in this embodiment, in order to improve the detection accuracy of the wire antenna 105, the wire antenna 105 is made flat, or substantially flat, so that the area of the wire antenna 105, which is responsible for the detection of the toner remainder amount, is increased in size.

As described above, in this embodiment, the same effects as those in the preceding embodiment are obtained by disposing the wire antenna in contact with the bottom surface 108 of the development chamber 10*b*. Further, the wire antenna is made flat, or substantially flat, in order to increase the surface area of the portion of the wire antenna responsible for the detection of the toner remainder amount, so that the toner-remainder amount is detected with improved accuracy.

Further, the wire antenna 105 in this embodiment is disposed in contact with the bottom surface 108 of the development chamber 10*b*. However, it may be fitted in a groove provided in the bottom wall of the development chamber 10*b* as illustrated in FIG. 14. This arrangement enjoys an advantage in that the toner is more smoothly circulated in the development chamber 10*b*.

Thus, the same effects as those in the preceding embodiment can be obtained by this embodiment. Further, according to this embodiment, the wire antenna is made flat, or substantially flat. Therefore, this embodiment enjoys an advantage in that the toner-remainder amount is detected with improved accuracy.

Next, referring to FIGS. 15–17, another embodiment of the present invention will be described. Since the general structure of the image forming apparatus in this embodiment is the same as that in the first embodiment illustrated in FIGS. 1 and 4, its description will be omitted.

In this embodiment, a wire antenna 110*a* constitutes a part of a toner seal 110.

Figure 16:
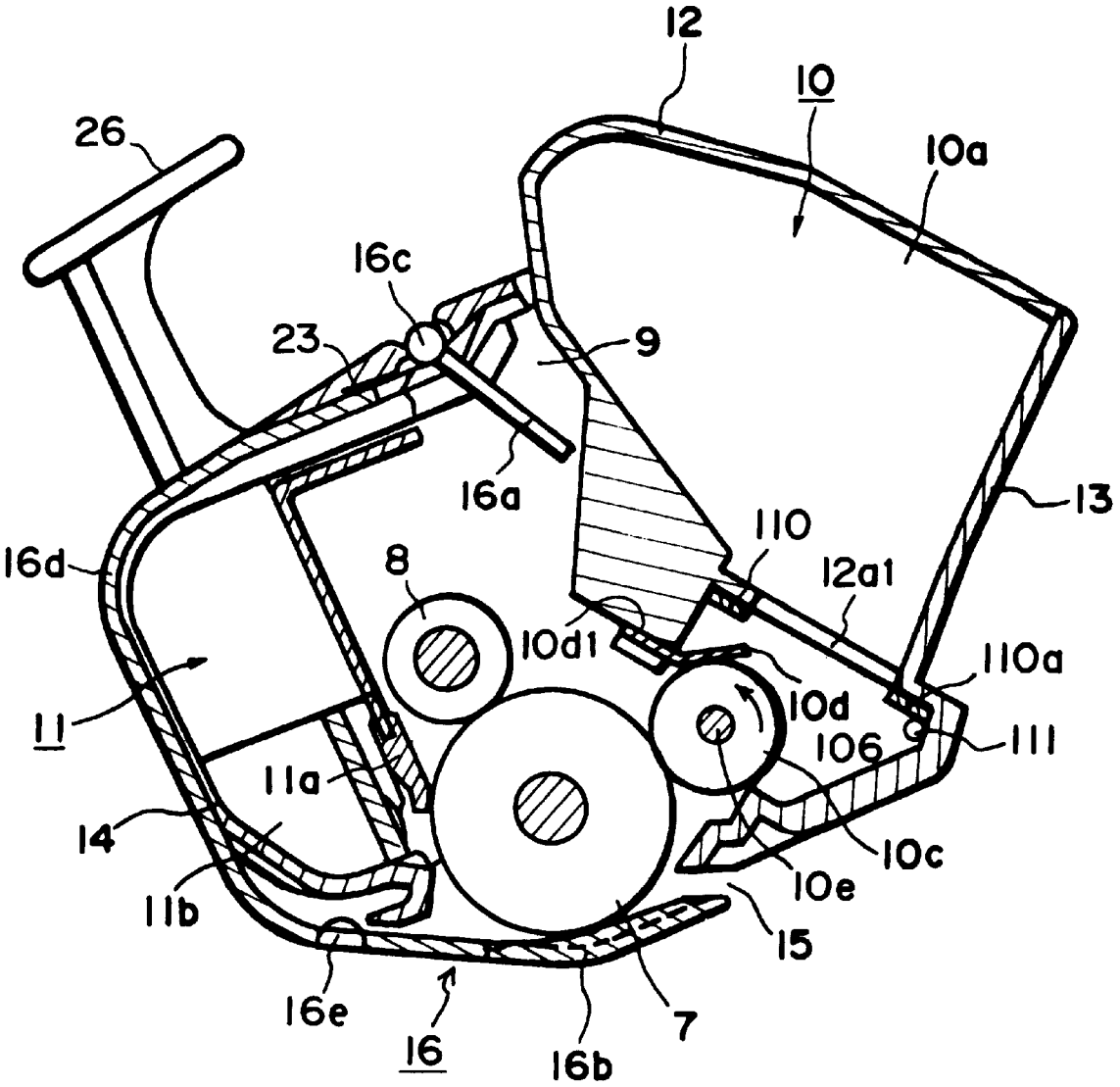
FIG. 16 is a cross-sectional view of the process cartridge illustrated in FIG. 15, and depicts the process cartridge from which the toner seal has been removed.

More specifically, referring to FIG. 16, the toner seal in this embodiment is constituted of an aluminum foil layer

110*b*, a PET layer 110*c* formed of mainly PET (polyethyleneterephthalate), and an adhesive layer 110*d*.

Figure 15:
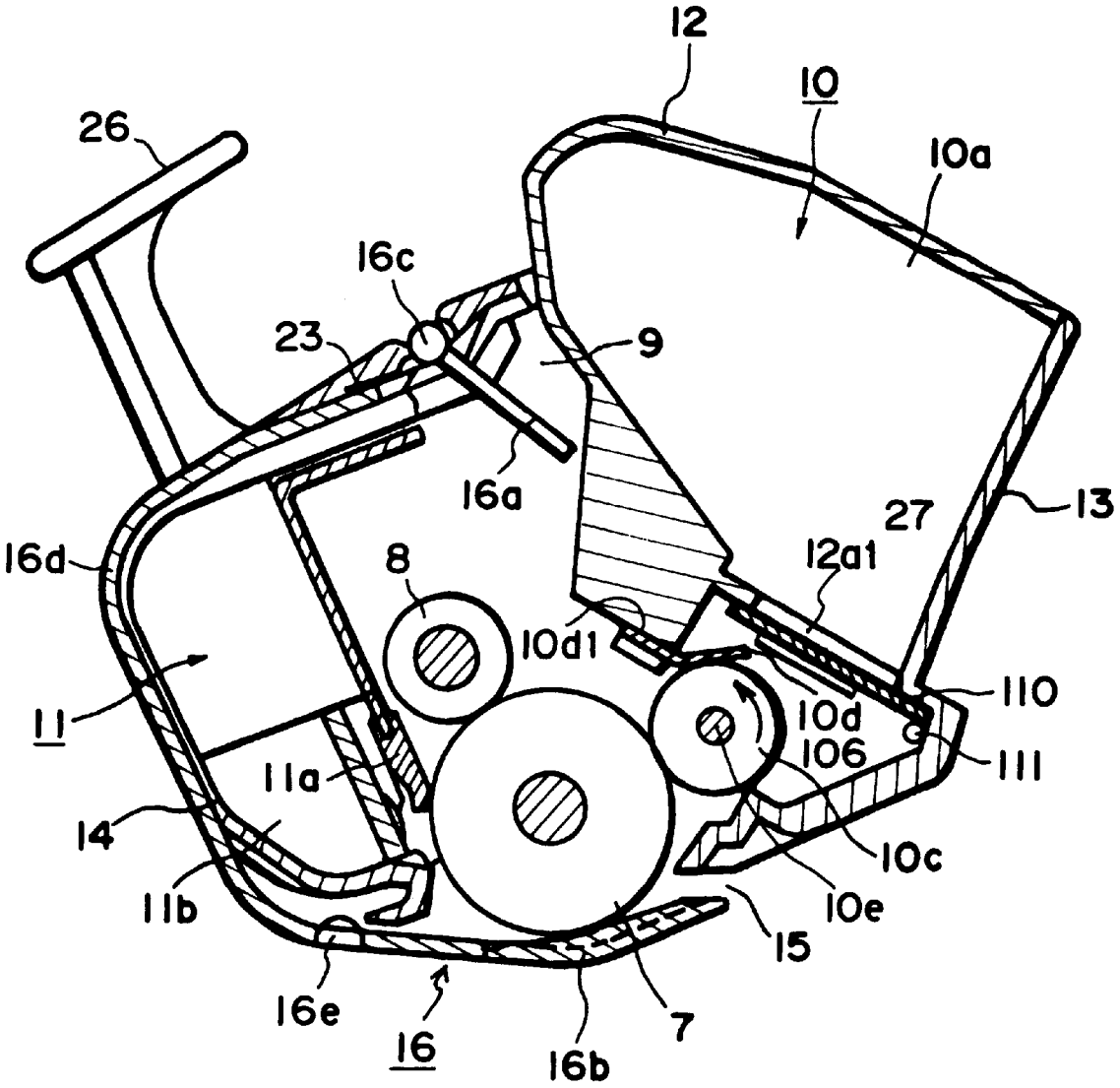
FIG. 15 is a cross-sectional view of the process cartridge in another embodiment, and depicts the general structure thereof.
Figure 17:
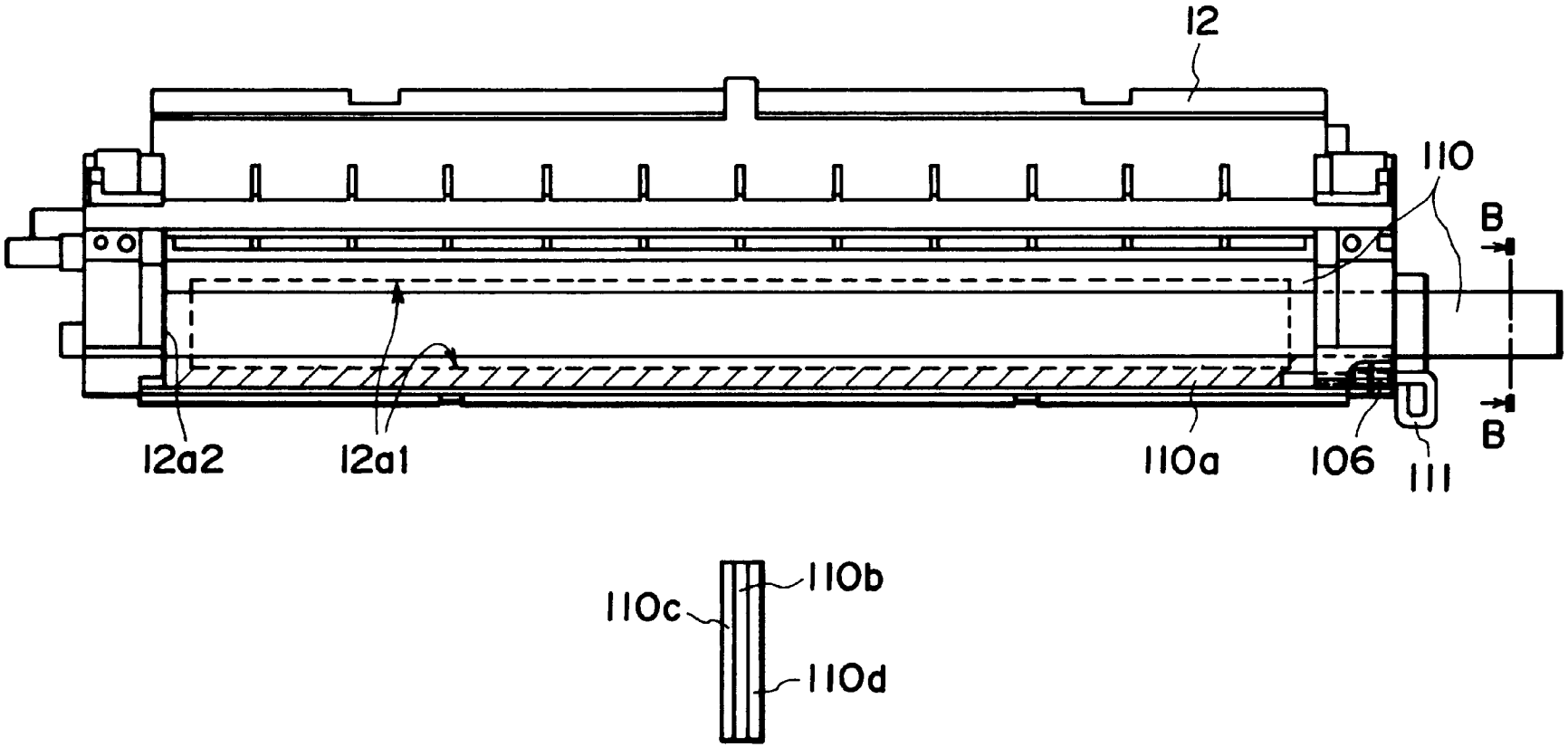
FIG. 17 is a schematic drawing which shows the structure of the toner sealing member.
Figure 18:
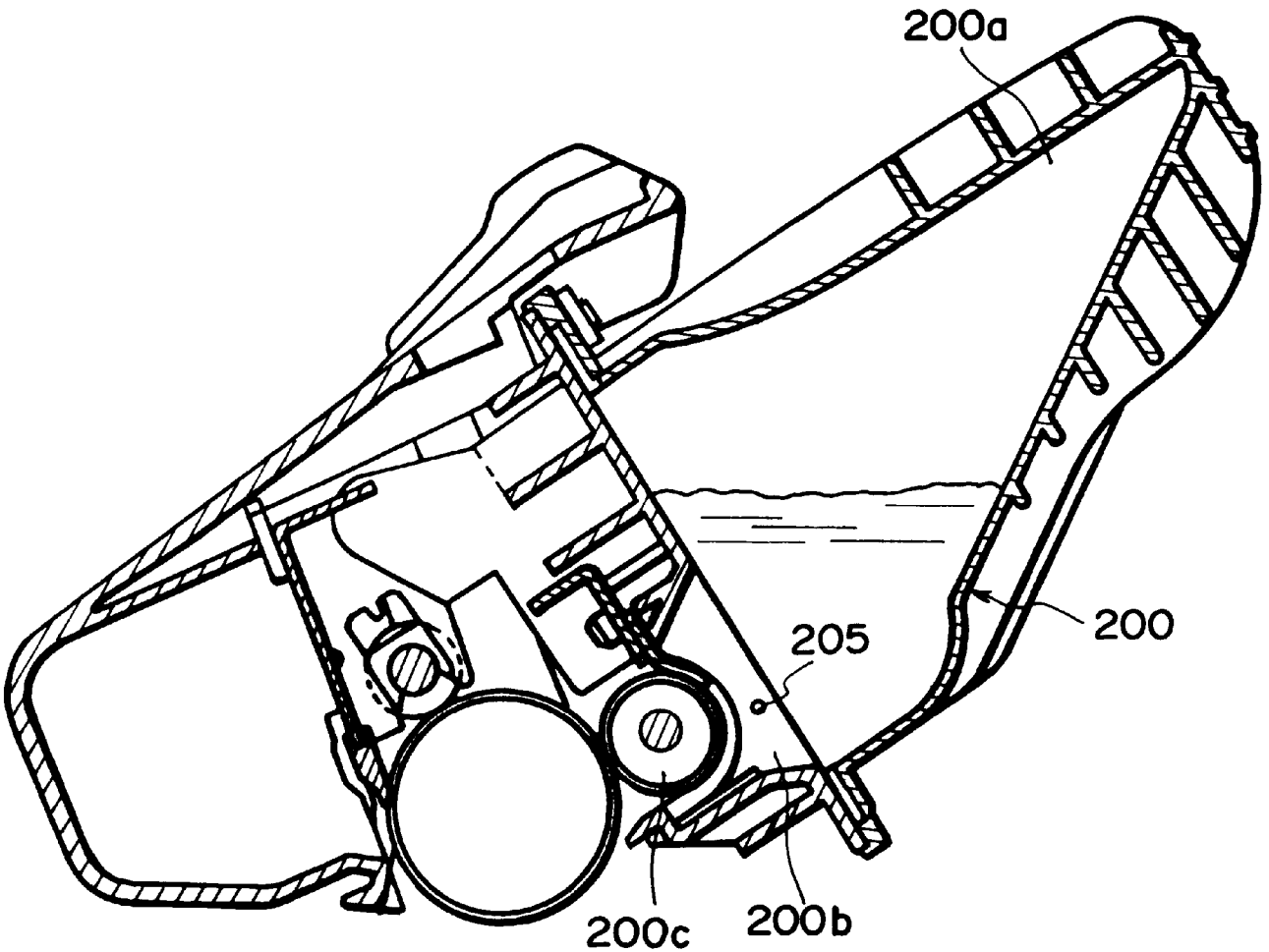
PRIOR ART FIG. 18
FIG. 18 is a cross-sectional view of a typical conventional process cartridge, and depicts the structure thereof.

The toner seal 110 is glued, or welded, to the adjacencies of the four edges of the toner supplying opening 12*a*1 of the toner/development chamber shell 12, to seal the toner/development chamber shell 12 from the development chamber 10*b* side as shown in FIGS. 15 and 17.

As the toner seal 110 is placed across the toner supplying opening 12*a*1 so that the adhesive layer 110*c* of the toner seal 110 faces the toner chamber 10*a*, the aluminum foil layer 110*b* of the toner seal 110 faces the development roller 10*c*.

The PET layer 110*c* and adhesive layer 110*d* are provided with grooves which run substantially parallel to the longitudinal edges of the toner supplying opening 12*a*1 to make the toner seal 110 easier to tear in the longitudinal direction.

In assembling the process cartridge B, the toner seal 110 is pasted to the toner seal attachment flange 12*a* provided along the four edges of the toner supplying opening 12*a*1. After covering the entire length of the toner supplying opening 12*a*1, the toner seal 110 is folded back at the longitudinal end 12*a*2 of the toner seal attachment flange, and is extended out of the process cartridge B through the hole 12*d* of the toner/development chamber shell 12.

With the above arrangement, as the end portion of the toner seal 110, which is extending out of the process cartridge B is pulled, the toner seal 110 is torn along the grooves, unsealing the toner supplying opening 12*a*1 of the toner/development chamber shell 12 so that the toner stored in the toner/development chamber shell 12 can be sent out from the toner chamber 10*a* into the development chamber 10*b*.

Thus, after the toner seal 110 is pulled out of the process cartridge B, a portion of the toner seal 110 remain on the toner seal attachment flange 12*a* around the toner supplying opening 12*a*1. This remaining portion of the toner seal 110 serves as the antenna 110*a* for detecting the toner-remainder amount.

The aluminum foil layer 110*b* of the antenna 110*a* is placed in contact with the contact portion 111 which is electrically in contact with the antenna contact portion of the apparatus main assembly 17. The contact portion 111 is put through the lateral wall of the toner/development chamber shell 12. The wire antenna 110*a* and contact portion 111 are screwed together with the use of a small screw (unillustrated) or the like, or glued together with the use of electrically conductive tape (unillustrated) or the like, to be enabled to establish electrical connection with the antenna contact portion 107.

As is described above, in this embodiment, the portion of the toner seal 110, which remains attached to the bottom edge portion of the toner supplying opening 12*a*1 after the toner seal 110 is pulled out of the process cartridge B, is used as the antenna 110*a*.

Further, the toner seal 110 may be designed to project outward through the lateral wall of the toner/development chamber shell 12, long enough to be glued or welded to the longitudinal end member so that the aluminum foil layer 110*b* faces outward. With this design, the antenna 110*a* doubles as its own contact portion.

In essence, in this embodiment, the toner seal 110 pasted along the four edges of the toner supplying opening 12*a*1 to seal the opening partially remains adhered to the edges even after the toner seal 110 is pulled out of the process cartridge B, and the portion that remain on the bottom side of the toner supplying opening 12*a*1 serves as the antenna 110*a* for detecting the toner remainder amount. Therefore, this embodiment offers not only the same effects as those in the first embodiment, but also an advantage that it can reduce the number of manufacturing steps for a development device or the like.

According to the preceding embodiments of the present invention, a developer-remainder-amount detecting member disposed within a development chamber detects the change in the electrostatic capacity between a developer bearing member and the developer remainder amount detecting member, and the amount of the developer remaining in a development device is determined based on the detected change. Therefore, even if a development device or the like is reduced in size, which is current trend, the developer-remainder amount can be accurately detected without interfering with the developer circulation in a development device or the like. Thus, it is assured that the problem that even though there is a sufficient amount of developer in a development chamber, a development member is not supplied with a sufficient amount of developer due to the interference to the developer circulation, is prevented, making it possible to produce an image which does not suffer from abnormal white spots.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus for developing a latent image formed on an electrophotographic photosensitive member comprising:

a development member for conveying developer to said electrophotographic photosensitive member to develop the latent image formed on the electrophotographic photosensitive member;

a developer storing portion for storing the developer to be used by said development member to develop the latent image;

a developer supplying opening for supplying the developer stored in said developer storing portion, to said development member; and a developer remainder amount notifying member disposed within said developer storing portion, away from the internal surface of said developer storing portion, for notifying a user of said developing apparatus of the developer remainder amount within said developing apparatus on the basis of an electrostatic capacity between said developer remainder amount notifying member and said development member.

2. A developing apparatus according to claim 1, wherein said developer remainder amount notifying member is disposed in a longitudinal direction of a development roller as said development member, and wherein said developer remainder amount notifying member is fixedly disposed within said developer storing portion.

3. A developing apparatus according to claim 2, wherein said developer remainder amount notifying member is connected to a notifying member contact portion which comes in contact with an apparatus contact portion with which an image forming apparatus is provided, and wherein said notifying member contact portion is disposed outside said developer storing portion.

4. A developing apparatus according to claim 3, wherein said developer remainder amount notifying member transmits signals proportional to a value of the electrostatic capacity between said developer remainder amount notifying member and said development roller as development bias is applied from a main assembly of the image forming apparatus to said development roller.

5. A developing apparatus according to claims 1 or 2, wherein when a value transmitted to a main assembly of an image forming apparatus by said developer remainder amount notifying member is no more than a predetermined value, a message "No Developer" is displayed on a monitor of the image forming apparatus.

6. A developing apparatus according to claim 5, wherein said predetermined value is a voltage value.

7. A developing apparatus according to claim 4, wherein said developer remainder amount notifying member is a nonmagnetic stainless steel rod.

8. A developing apparatus according to claims 1 or 2, wherein said developer supplying opening is covered with a seal, which is to be pulled out to unseal said developer supplying opening so that the developer stored in said developer storing portion is supplied into said development member through said developer supplying opening.

9. A developing apparatus according to claims 1 or 2, wherein said developing apparatus is integrally disposed, along with said electrophotographic photosensitive member, in a cartridge, forming a process cartridge removably installable in a main assembly of an image forming apparatus.

10. A process cartridge removably installable in a main assembly of an image forming apparatus comprising:

an electrophotographic photosensitive member;

a developing apparatus for developing a latent image formed on said electrophotographic photosensitive member;

wherein said developing apparatus comprises:

a development member for conveying developer to said electrophotographic photosensitive member;

a developer storing portion for storing the developer used by said development member to develop the latent image;

a developer supplying opening for supplying the developer stored in said developer storing portion, to said development member; and a developer remainder amount notifying member disposed within said developer storing portion, away from the internal surface of said developer storing portion, for notifying a user of said process cartridge of the developer remainder amount within said process cartridge on the basis of an electrostatic capacity between said developer remainder amount notifying member and said development member.

11. A process cartridge according to claim 10, wherein said developer remainder amount notifying member is disposed in a longitudinal direction of a development roller as said development member, and wherein said developer remainder amount notifying member is fixedly disposed within said developer storing portion.

12. A process cartridge according to claim 11, wherein said developer remainder amount notifying member is connected to a notifying member contact portion which comes in contact with an apparatus contact portion with which an image forming apparatus is provided, and wherein said notifying member contact portion is disposed outside said developer storing portion.

13. A process cartridge according to claim 12, wherein said developer remainder amount notifying member transmits signals proportional to a value of the electrostatic capacity between said developer remainder amount notifying member and development roller as development bias is applied from the main assembly of the image forming apparatus to said development roller.

14. A process cartridge according to claims 10 or 11, wherein when a value transmitted to the main assembly of the image forming apparatus by said developer remainder amount notifying member is no more than a predetermined value, a message "No Developer" is displayed on a monitor of the image forming apparatus.

15. A process cartridge according to claim 14, wherein said predetermined value is a voltage value.

16. A process cartridge according to claim 13, wherein said developer remainder amount notifying member is a nonmagnetic stainless steel rod.

17. A process cartridge according to claims 10 or 11, wherein said developer supplying opening is covered with a seal, which is to be pulled out to unseal said developer supplying opening so that the developer stored in said developer storing portion is supplied into said development member through said developer supplying opening.

18. A process cartridge according to claims 10 or 11, wherein said developing apparatus is integrally disposed, along with said electrophotographic photosensitive member, in a cartridge, forming a process cartridge removably installable in the main assembly of an image forming apparatus.

19. A process cartridge according to claims 10 or 11, wherein said electrophotographic photosensitive member is supported by a photosensitive member frame;

said development member is supported by a development frame;

said developer storing portion is provided in a developer frame; and wherein said development frame and developer frame are fixedly joined to each other, and said fixedly joined development frame and developer frame are pivotally joined with said photosensitive member frame.

20. A process cartridge removably installable in a main assembly of an image forming apparatus comprising:

an electrophotographic photosensitive member;

a photosensitive member frame which supports said electrophotographic photosensitive member; and a developing apparatus for developing a latent image formed on said electrophotographic photosensitive member;

wherein said developing apparatus comprises:

a development roller for conveying developer to said electrophotographic photosensitive member;

a development frame which supports said development roller;

a developer storing portion for storing the developer to be used by said development roller to develop the latent image;

a developer supplying opening for supplying the developer stored in said developer storing portion, to said development roller;

a seal for removably sealing said developer supplying opening, which is to be pulled out to unseal said developer supplying opening so that the developer stored in said developer storing portion is supplied into said development roller through said developer supplying opening;

a developer remainder amount notifying member disposed within said developer storing portion, away from the internal surface of said developer storing portion, for notifying a user of said process cartridge on the developer remainder amount within said process cartridge on the basis of an electrostatic capacity between said developer remainder amount notifying member and said development roller, said developer remainder amount notifying member being disposed in a longitudinal direction of said development roller and transmitting signals proportional to a value of the electrostatic capacity between said developer remainder amount notifying member and development roller as development bias is applied from the main assembly of the image forming apparatus to said development roller;

a notifying member contact portion which comes in contact with an apparatus contact portion provided on the main assembly of the image forming apparatus, said notifying member contact portion being connected to said developer remainder amount notifying member, and being disposed outside said developer storing portion; and a developer frame comprising said developer storing portion and developer supplying opening, and fixedly supporting said developer remainder amount notifying member and notifying member contact portion;

wherein said development frame and developer frame are fixedly joined to each other, and said fixedly joined development frame and developer frame are pivotally joined with said photosensitive member frame.

21. A process cartridge according to claim 20, wherein when the value transmitted to the main assembly of the image forming apparatus by said developer remainder amount notifying member is no more than a predetermined value, a message "No Developer" is displayed on a monitor of the image forming apparatus.

22. A cartridge according to claim 21, wherein said predetermined value is a voltage value.

23. A process cartridge according to claims 20, 21, or 22, wherein said developer remainder amount notifying member is a nonmagnetic stainless steel rod.

24. A process cartridge according to claims 10 or 20, comprising a charging member for charging said electrophotographic photosensitive member.

25. A process cartridge according to claim 24, comprising a cleaning member for removing the developer remaining on said electrophotographic photosensitive member.

* * * * *

UNITED STATES PATENT AND TRADEMARK OFFICE

CERTIFICATE OF CORRECTION

PATENT NO. : 6,141,508

DATED : October 31, 2000

INVENTOR(S): TERUHIKO SASAKI, ET AL.

It is certified that error appears in the above-identified patent and that said Letters Patent is hereby corrected as shown below:

COLUMN 2:
Line 16, "is" should read --is to--.
Line 24, "through" should read --though--.
Line 65, "sell" should read --shell--.

COLUMN 4:
Line 18, "3b." should read --3f.--.

COLUMN 7:
Line 27, "to" should read --is--.

COLUMN 10:
Line 22, "therefore," should read --Therefore--.

COLUMN 11:
Line 67, "remain" should read --remains--.

UNITED STATES PATENT AND TRADEMARK OFFICE

CERTIFICATE OF CORRECTION

PATENT NO. : 6,141,508

DATED : October 31, 2000

INVENTOR(S): TERUHIKO SASAKI, ET AL.

It is certified that error appears in the above-identified patent and that said Letters Patent is hereby corrected as shown below:

COLUMN 12:

Line 11, "developer remainder amount" should read --developer-remainder-amount--.

Line 16, "remainder amount" should read --remainder-amount--.

Signed and Sealed this

First Day of May, 2001

*Attest:*

Nicholas P. Godici

NICHOLAS P. GODICI

*Attesting Officer*

*Acting Director of the United States Patent and Trademark Office*